US008770582B2

(12) United States Patent
Kushida

(10) Patent No.: US 8,770,582 B2
(45) Date of Patent: Jul. 8, 2014

(54) SHEET PROCESSING APPARATUS AND IMAGE FORMING APPARATUS

(71) Applicant: Canon Kabushiki Kaisha, Tokyo (JP)

(72) Inventor: Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/953,958

(22) Filed: Jul. 30, 2013

(65) Prior Publication Data

US 2014/0054854 A1 Feb. 27, 2014

(30) Foreign Application Priority Data

Aug. 27, 2012 (JP) ..... 2012-186468

(51) Int. Cl.
*B65H 29/54* (2006.01)

(52) U.S. Cl.
USPC ..... 271/306; 271/3.01; 271/3.03; 271/198; 271/207

(58) Field of Classification Search
USPC ..... 271/3.01, 3.03, 225, 245, 306, 198, 207
See application file for complete search history.

(56) References Cited

U.S. PATENT DOCUMENTS

| | | | | |
|---|---|---|---|---|
| 5,370,384 | A * | 12/1994 | Romanowski | 271/297 |
| 6,196,542 | B1 | 3/2001 | Allmendinger | |
| 7,874,553 | B2 | 1/2011 | Kushida et al. | |
| 8,172,224 | B2 | 5/2012 | Kushida | |
| 8,528,898 | B2 | 9/2013 | Kushida | |
| 2006/0181017 | A1* | 8/2006 | Peulen | 271/314 |
| 2008/0179809 | A1* | 7/2008 | Kikkawa et al. | 270/58.11 |
| 2010/0078878 | A1* | 4/2010 | Nakamura et al. | 271/220 |
| 2012/0025452 | A1* | 2/2012 | Terao et al. | 271/207 |
| 2012/0319346 | A1 | 12/2012 | Iwata et al. | |
| 2013/0026703 | A1 | 1/2013 | Watanabe et al. | |

FOREIGN PATENT DOCUMENTS

| | | |
|---|---|---|
| EP | 0945383 A2 | 9/1999 |
| EP | 0945383 B1 | 9/2003 |

* cited by examiner

*Primary Examiner* — Prasad Gokhale
(74) *Attorney, Agent, or Firm* — Fitzpatrick, Cella, Harper & Scinto

(57) ABSTRACT

In a conveying belt that is entrained about a pair of bundle discharge rollers along a stacking wall, on which an end part of a sheet stacked on a stack tray abuts, between the stack tray and an intermediate processing tray, a position of an outer peripheral surface is displaced such that a projection amount of the conveying belt from the stacking wall is large when the pair of discharge rollers discharges the sheet to the stacking portion, and such that the projection amount is small when the pair of discharge rollers moves the sheet toward a stopper of the intermediate stacking portion.

12 Claims, 19 Drawing Sheets

SHEET PROCESSING APPARATUS AND IMAGE FORMING APPARATUS

BACKGROUND OF THE INVENTION

1. Field of the Invention

The present invention relates to a sheet processing apparatus, which receives a sheet discharged from such an image forming apparatus such as a copying machine and a printer, selectively performs a process to the received sheet, and discharged and stacks the sheet, and an image forming apparatus provided with the sheet processing apparatus.

2. Description of the Related Art

Conventionally, in the sheet processing apparatus that performs a binding process and a sorting process to the sheet in which an image is formed, the binding process and the sorting process are selectively performed on an intermediate processing tray, and the sheet (or a sheet bundle) on the intermediate processing tray is discharged and stacked on a stack tray by a discharge roller.

In the sheet processing apparatus, the sheet discharged toward the stack tray by the discharge roller falls freely and is stacked on the stack tray without guiding the sheet to a sheet stacking surface of the stack tray.

Therefore, for example, U.S. Pat. No. 6,196,542 proposes a sheet processing apparatus that performs lowering and stacking of the sheet discharged by the discharge roller toward the stack tray while guiding the sheet.

In the sheet processing apparatus disclosed in U.S. Pat. No. 6,196,542, by rotating a belt entrained about the discharge roller, a rear end of the sheet discharged by the discharge roller is lowered toward the stack tray to be stacked while supported on an elastic finger provided in a surface of the belt.

However, in some conventional sheet processing apparatuses, the discharge roller rotates normally and reversely in order to perform switchback to the sheet on the intermediate processing tray. In this case, although the finger lowered by the rotating and moving belt holds the rear end of the already-stacked sheet during the normal rotation of the discharge roller, the finger lifts the rear end of the sheet by the rotating and moving belt during the reverse rotation. Therefore, although a sheet end part can be held during the normal rotation, the rear end of the sheet stacked on the stack tray is disarrayed during the reverse rotation.

SUMMARY OF THE INVENTION

It is desirable to provide a sheet processing apparatus that can hold the end part of the sheet during the normal rotation, and does not disarray the end part of the stacked sheet during the reverse rotation.

In accordance with one aspect of the present invention, a sheet processing apparatus includes: a conveying portion that conveys a sheet; an intermediate stacking portion that temporarily stacks the sheet conveyed by the conveying portion; a stopper that regulates an upstream end in a conveyance direction of the sheet stacked on the intermediate stacking portion; a stacking portion on which the sheet discharged from the intermediate stacking portion is stacked; a pair of discharge rollers that is provided in the intermediate stacking portion to move the sheet conveyed to the intermediate stacking portion toward the stopper or to discharge the sheet regulated by the stopper to the stacking portion according to a rotation direction; a wall that is provided between the stacking portion and the pair of discharge rollers, the upstream end in the conveyance direction of the sheet discharged to the stacking portion abutting on the wall; and an endless belt that includes an outer peripheral surface along the wall, the outer peripheral surface moving in conjunction with rotation of the pair of discharge rollers, wherein a projection amount of the outer peripheral surface of the endless belt from the wall, when the pair of discharge rollers discharges the sheet to the stacking portion, is larger than the projection amount when the pair of discharge rollers moves the sheet toward the stopper of the intermediate stacking portion.

According to the present invention, when the pair of discharge rollers discharges the sheet to the stacking portion, the end part of the discharged sheet abuts on the endless belt to scrape the sheet, and the sheet is stacked on the stacking portion. When the pair of discharge rollers moves the sheet toward the stopper of the intermediate stacking portion, the end part of the sheet stacked on the stacking portion does not abut on the endless belt. Therefore, the endless belt can hold the sheet toward the stacking tray when the sheet is discharged to the stacking portion, and the sheet end part is hardly disarrayed by the endless belt when the sheet is moved toward the stopper of the intermediate stacking portion.

Further features of the present invention will become apparent from the following description of exemplary embodiments with reference to the attached drawings.

DESCRIPTION OF THE EMBODIMENTS

In the following, exemplary embodiments of the present invention will be described in detail in an exemplified manner with reference to the drawings. Here, dimensions, materials, shapes and relative arrangement of structural components described in the following embodiments may be appropriately modified in accordance with apparatus configurations to which the present invention is applied and various conditions. Therefore, unless otherwise specified, the scope of the present invention is not to be limited thereto.

Figure 1:
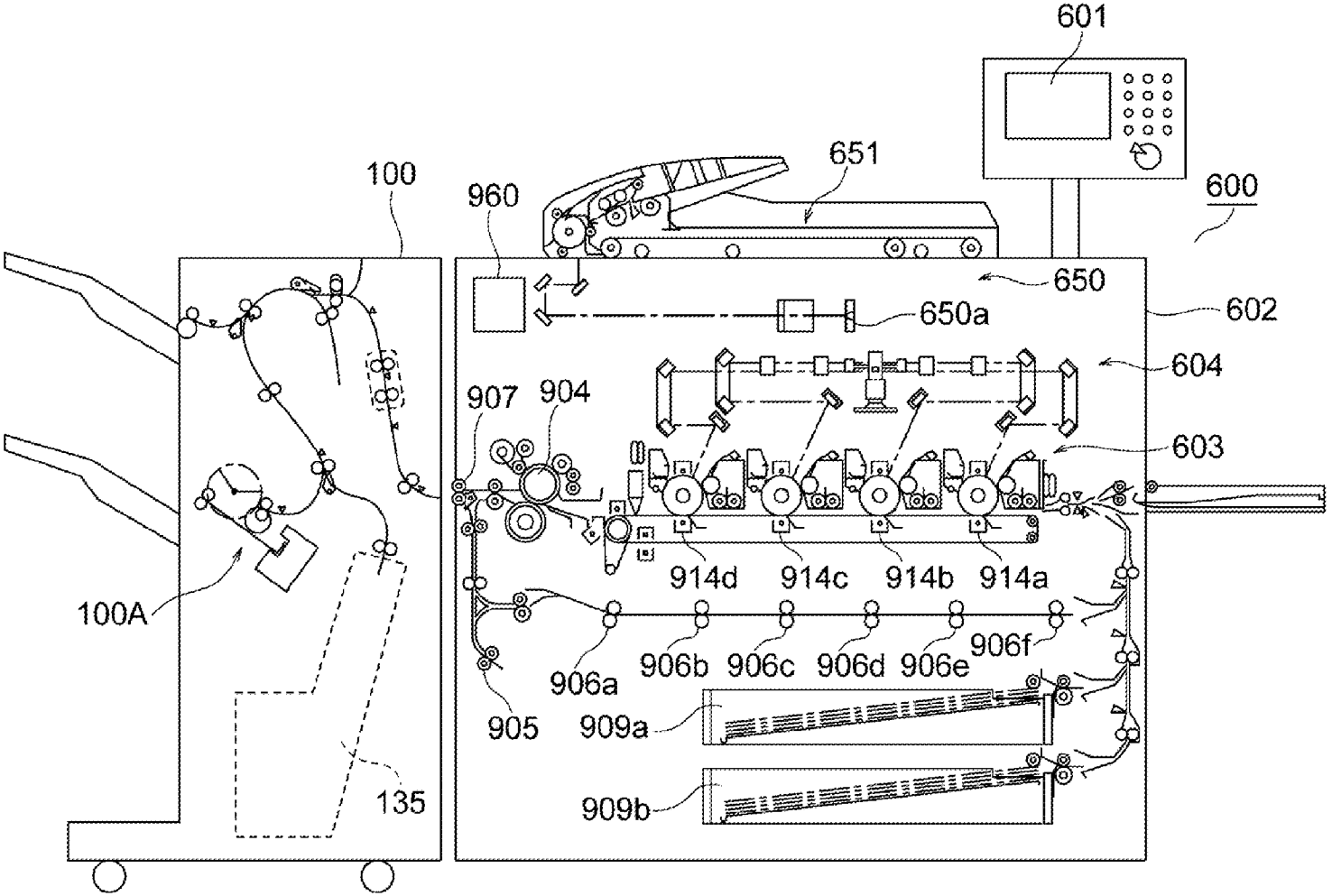
FIG. 1 is a sectional view illustrating a configuration of an image forming apparatus provided with a sheet processing apparatus.

FIG. 1 is a sectional view illustrating a configuration of an image forming apparatus provided with a sheet processing apparatus according to an embodiment of the present invention. Referring to FIG. 1, an image forming apparatus 600 includes an image forming apparatus body (hereinafter referred to as an apparatus body) 602, an original reading portion (image reader) 650 that is provided in an upper part of the apparatus body 602, and an original conveying apparatus 651 that automatically reads a plurality of originals.

The apparatus body 602 includes sheet cassettes 909*a* and 909*b* on each of which a normal sheet S used to form an image is stacked, an image forming portion 603 that forms a toner image on the sheet through an electrophotographic process, and a fixing portion 904 that fixes the toner image formed on the sheet. An operation portion 601 is connected to an upper surface of the apparatus body 602 in order that a user performs various inputs/settings to the apparatus body 602, and a finisher 100 that is the sheet processing apparatus is connected to a lateral part of the apparatus body 602. A controller 960 controls the apparatus body 602 and the sheet processing apparatus 100.

Hereinafter, a position where the user faces the operation portion 601 in order to perform the various inputs/settings to the apparatus body 602 is referred to as a front side of the image forming apparatus, and an apparatus rear side that is an opposite side to the front side is referred to as a back side. A front-back direction of the image forming apparatus is a width direction orthogonal to a sheet conveyance direction (or a sheet discharge direction). FIG. 1 illustrates the configuration of the image forming apparatus when the apparatus is viewed from the front side. The finisher 100 is connected to the lateral part on a sheet discharge port side of the apparatus body 602.

In the image forming apparatus 600, in order to form the image of the original (not illustrated) on the sheet, an image sensor 650*a* provided in the original reading portion 650 reads the image of the original conveyed by the original conveying apparatus 651. Then read digital data is input to an exposure portion 604, and the exposure portion 604 irradiates a photosensitive drums 914 (914*a* to 914*d*) provided in an image forming portion 603 with light corresponding to the digital data. When the photosensitive drum 914 is irradiated with the light, electrostatic latent images are formed on photosensitive drum surfaces. Yellow, magenta, cyan, and black toner images are formed on the photosensitive drum surfaces by developing the electrostatic latent images.

The four-color toner images are transferred onto the sheet fed from one of the sheet cassettes 909*a* and 909*b*, and the fixing portion 904 fixes the toner images transferred onto the sheet. After the toner images are fixed, the sheet is directly discharged from a pair of discharge rollers 907 to the finisher 100 in a mode in which the image is formed on a single side of the sheet.

In a mode in which the images are formed on both sides of the sheet, the sheet is delivered from the fixing portion 904 to an inverting roller 905, and the inverting roller 905 is inverted in predetermined timing to convey the sheet toward double-sided conveying rollers 906*a* to 906*f*. Then, the sheet is conveyed to the image forming portion 603 again, and the yellow, magenta, cyan, and black toner images are transferred to a rear surface of the sheet. The sheet in which the four colors of yellow, magenta, cyan, and black toner images are transferred to the rear surface is conveyed to the fixing portion 904 again to fix the toner images, the sheet is discharged from the pair of discharge rollers 907 and conveyed to the finisher 100 connected to the lateral part of the apparatus body 602.

Figure 2:
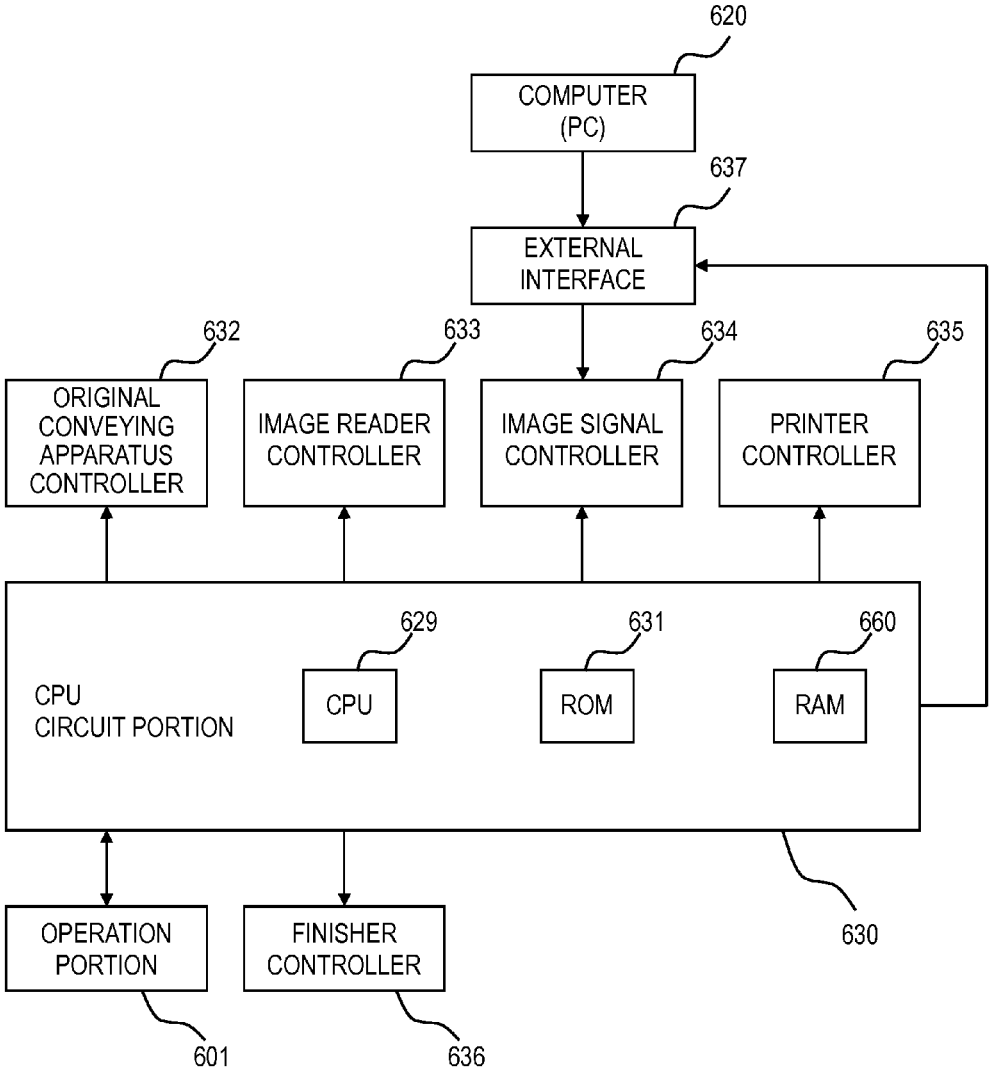
FIG. 2 is a block diagram of a controller of the image forming apparatus.

FIG. 2 is a block diagram illustrating the configuration of the image forming apparatus provided with the sheet processing apparatus. Referring to FIG. 2, a CPU circuit portion 630 is disposed at a predetermined position of the apparatus body 602. The CPU circuit portion 630 includes a CPU 629, a ROM 631, and a RAM 660. A control program and the like are stored in the ROM 631. The RAM 660 is used as an area for temporarily storing control data or a work area for arithmetic operations associated with control operations.

An external interface 637 is one between the image forming apparatus 600 and an external PC (personal computer) 620. When receiving print data from the external PC 620, the external interface 637 expands the print data to a bit-mapped image, and outputs the image data to an image signal controller 634.

The image signal controller 634 outputs the image data to a printer controller 635, and the printer controller 635 outputs the data image data from the image signal controller 634 to an exposure controller (not illustrated). An image reader controller 633 outputs the image of the original read by the image sensor 650*a* (see FIG. 1) to the image signal controller 634, and the image signal controller 634 outputs the image to the printer controller 635.

The operation portion 601 includes a plurality of keys and a display portion. The keys are used to set various functions relating to the image formation. The display portion displays a setting state. The operation portion 601 outputs a key signal to the CPU circuit portion 630 in response to a key operation of the user, and displays corresponding information on a display portion based on a signal from the CPU circuit portion 630.

The CPU circuit portion 630 controls the image signal controller 634 according to the control program stored in the ROM 631 and the setting of the operation portion 601, and controls the original conveying apparatus 651 (see FIG. 1) through an original conveying apparatus controller 632. The CPU circuit portion 630 controls the original reading portion 650 (see FIG. 1) through the image reader controller 633, controls the image forming portion 603 (see FIG. 1) through the printer controller 635, and controls the finisher 100 through the finisher controller 636.

The finisher controller 636 is mounted on the finisher 100, and performs driving control of the finisher 100 by transmitting and receiving information to and from the CPU 629 of the CPU circuit portion 630. Alternatively, the finisher controller 636 may be provided on the apparatus body side integrally with the CPU circuit portion 630, and the finisher 100 may directly be controlled from the apparatus body side.

Figure 3:
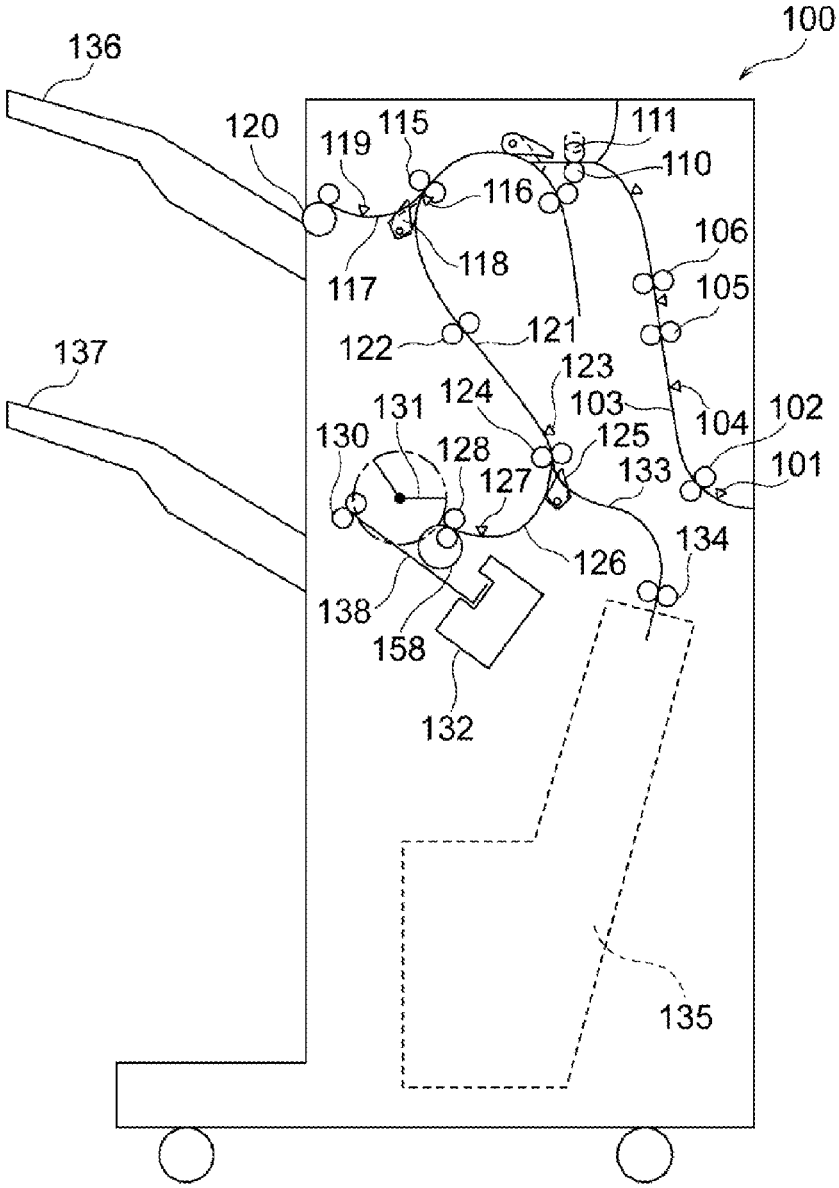
FIG. 3 is a schematic sectional view illustrating a configuration of a finisher that is the sheet processing apparatus.

FIG. 3 is a sectional view of the finisher 100. The finisher 100 is configured to sequentially take in the sheet discharged from the apparatus body 602 and to perform a process to align the taken-in plurality of sheets to pack into a bundle and a punch process to punch a neighborhood of a rear end of the taken-in sheet. The finisher 100 includes a stapling portion 100A that staples the sheets on an intermediate processing tray 138 and a saddle unit 135 that binds a sheet bundle in a twofold manner. That is, the finisher 100 performs a staple process (binding process) to staple the rear end side of the sheet bundle and a bookbinding process.

The finisher 100 includes a pair of entrance rollers 102 that takes the sheet discharged from the apparatus body 602 into the apparatus, and the sheet discharged from the apparatus body 602 is delivered to the pair of entrance rollers 102. At this point, an entrance sensor 101 detects sheet delivery timing.

Then the sheet conveyed by the pair of entrance rollers 102 passes through a conveying path 103, and the sheet is conveyed to reach a pair of buffer rollers 115 by a conveying roller 110 and a separation roller 111 through conveying rollers 105 and 106. In a case that the sheet is discharged to an upper tray 136, an upper path switching member 118 is put into a state indicated by a broken line in FIG. 3 by a driving portion such as a solenoid (not illustrated). Therefore, the sheet is guided to an upper path conveying path 117, and discharged onto the upper tray 136 by an upper discharge roller 120.

In a case that the sheet is not discharged to the upper tray 136, the sheet conveyed by the pair of buffer rollers 115 is guided to a bundle conveying path 121 by the upper path switching member 118 in the state indicated by a solid line in FIG. 3. The sheet passes through the conveying path by a conveying roller 122 and a pair of conveying rollers 124.

In a case that the sheet is discharged to a lower stack tray 137 that is the sheet stacking portion, which stacks the conveyed sheet, the sheet is conveyed to a lower path 126 by a saddle path switching member 125 in the state indicated by the solid line in FIG. 3. Then the sheet is discharged to the intermediate processing tray 138 by a pair of lower discharge rollers 128 that is the conveying portion. The discharged sheets are aligned by a returning portion such as a paddle 131 and a belt roller 158 while sequentially stacked thereon, and an aligning process is performed to the aligned and stacked sheet bundle including a predetermined number of sheets on the intermediate processing tray 138.

As needed basis, a stapler 132 performs a side-stitching process to the sheet bundle to which the aligning process is performed on the intermediate processing tray 138. Then the sheet bundle is discharged to the lower stack tray 137 by a pair of bundle discharge rollers 130. The stapler 132 is movable in a width direction orthogonal to the sheet discharge direction, and a binding process can be performed to a plurality of places in a rear end part of the sheet bundle.

On the other hand, in a case that a saddle (saddle-stitching) process is performed to the sheets, the saddle path switching member 125 is moved to the position indicated by the broken line in FIG. 3 by the driving portion such as the solenoid (not illustrated). Therefore, the sheet is conveyed to a saddle path 133 and guided to the saddle unit 135 by a pair of saddle inlet rollers 134, and the saddle (saddle-stitching process) process is performed to the sheet.

Figure 4A:
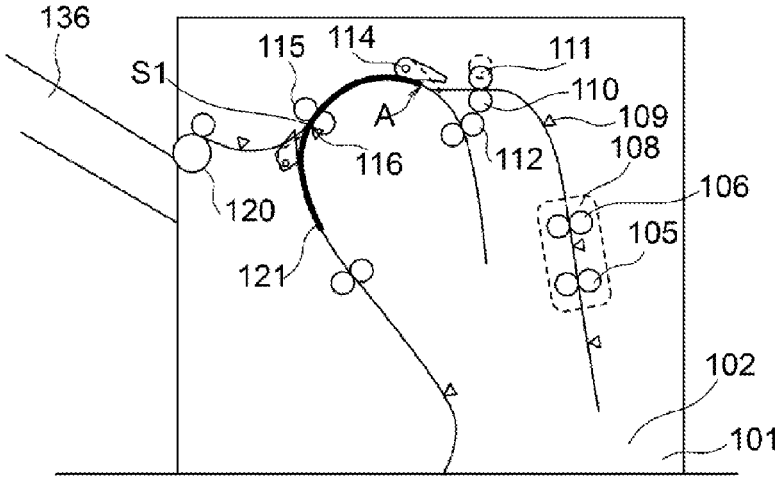
FIGS. 4A, 4B, and 4C are motion drawings of the finisher.

During the conveyance, sheet timing is controlled while conveyance sensors 104, 123, and 127 detect a sheet end part. It is well known that usually a given process time is necessary for the side-stitching process or the saddle process. The process time depends partially on an image forming rate of the image forming apparatus. At the same time, the side-stitching process or the saddle process is hardly completed within a sheet-discharge time interval, and usually the process time exceeds the sheet-discharge time interval. Therefore, there is well known a process method called a sheet buffering process in which the sheet is processed without stopping the image formation of the image forming apparatus. The sheet buffering process will be described below with reference to FIG. 4.

A sheet S1 conveyed by the conveying roller 110 and the separation roller 111 is guided to the bundle conveying path 121 by the pair of buffer rollers 115. At this point, a buffer sensor 116 detects a leading end position of the sheet S1, and the driving portion (not illustrated) controls stopping of the pair of buffer rollers 115 from previously-recognized sheet size information such that the sheet S1 is stopped when a sheet rear-end position reaches an A position (see FIG. 4A).

Figure 4B:
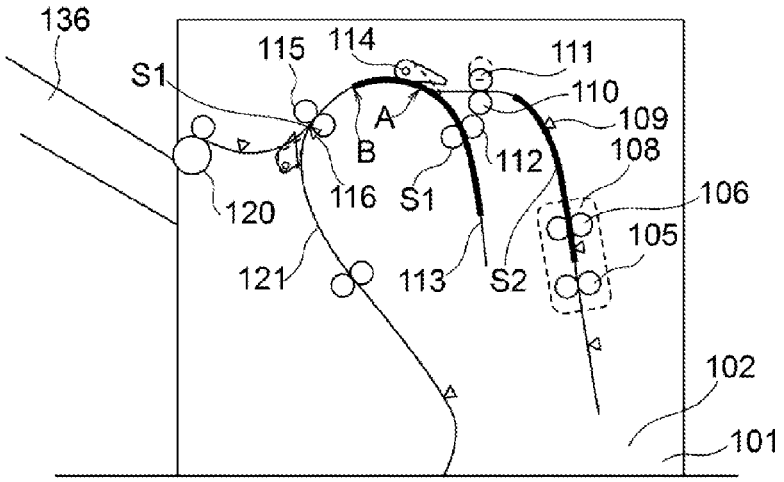
Figure 4C:
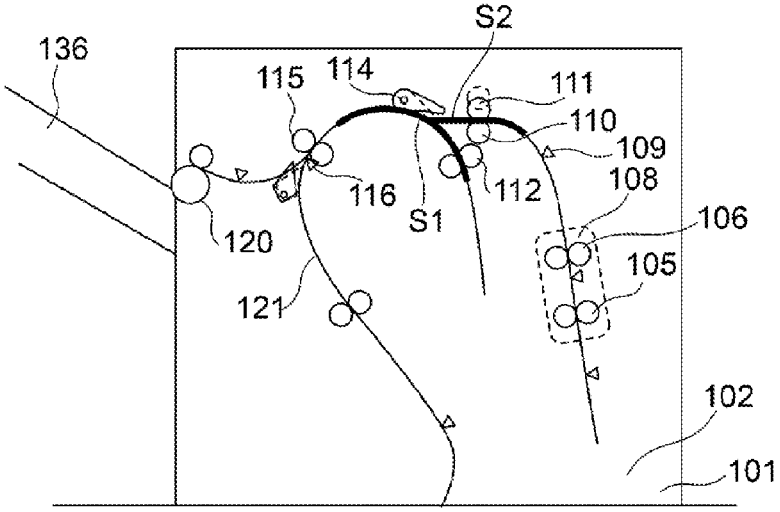

The pair of buffer rollers 115 performs reverse rotation motion while the driving portion such as the solenoid (not illustrated) puts a buffer path switching member 114 in the state indicated by the broken line in FIG. 4, whereby the sheet rear end is guided to a buffer path 113. The sheet S1 is reversely conveyed until the sheet leading end position reaches a B position (see FIG. 4B).

After a buffer sensor 109 detects a leading end position of a subsequently-conveyed sheet S2, driving of a pair of buffer rollers 112 is started such that the leading end position of the sheet S2 becomes identical to that of the sheet S1 while the sheet S1 reaches a conveying speed. Therefore, the leading end positions of the sheets S1 and S2 are aligned with each other (see FIG. 4C).

In a case that an overlapping process is performed to one more sheet, the pair of buffer rollers 115 is driven until the rear end portions of the sheets S1 and S2 reach the A position. Then the above process is repeated to be able to perform the overlapping process to one more sheet.

After the overlapping process is performed to a predetermined number of sheets, the sheet bundle including the plurality of sheets is conveyed downstream to the intermediate processing tray portion or the saddle unit by the conveying roller 122 and the pair of bundle conveying rollers 124.

Figure 5:
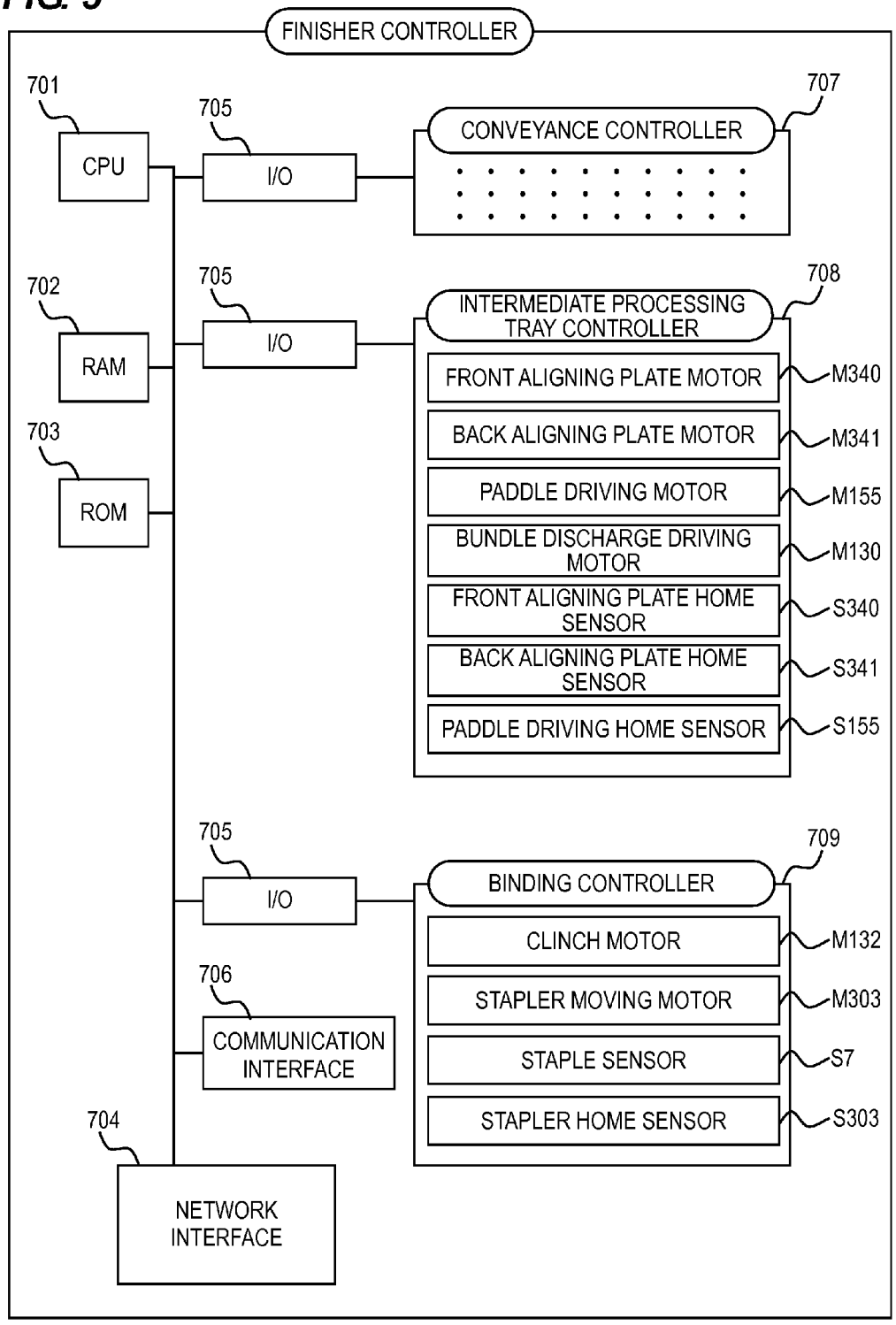
FIG. 5 is a block diagram of a controller of the finisher.

FIG. 5 is a control block diagram of the finisher 100 of the embodiment. The finisher controller 636 includes a CPU (microcomputer) 701, a RAM 702, a ROM 703, a plurality of input/output portions (I/O) 705, a communication interface 706, and a network interface 704.

A conveyance controller 707, an intermediate processing tray controller 708, and a binding controller 709 are connected to the input/output portions (I/O) 705, respectively. The conveyance controller 707 controls a sheet horizontal registration detecting process, the sheet buffering process, and the conveying process. The intermediate processing tray controller 708 performs driving control of a front aligning plate motor M340, a back aligning plate motor M341, a paddle driving motor M155, and a bundle discharge driving motor M130.

A front aligning plate home sensor S340, a back aligning plate home sensor S341, and a paddle driving home sensor S155 are connected to the intermediate processing tray controller 708. The intermediate processing tray controller 708 performs aligning plate motion control, a retractable paddle motion control, and swing guide opening and closing control using a home position sensor and moving motor. The binding controller 709 performs driving control of a clinch motor M132 and a stapler moving motor M303, and a staple sensor S7 and a stapler home sensor S303 is connected to the binding controller 709.

Figure 6:
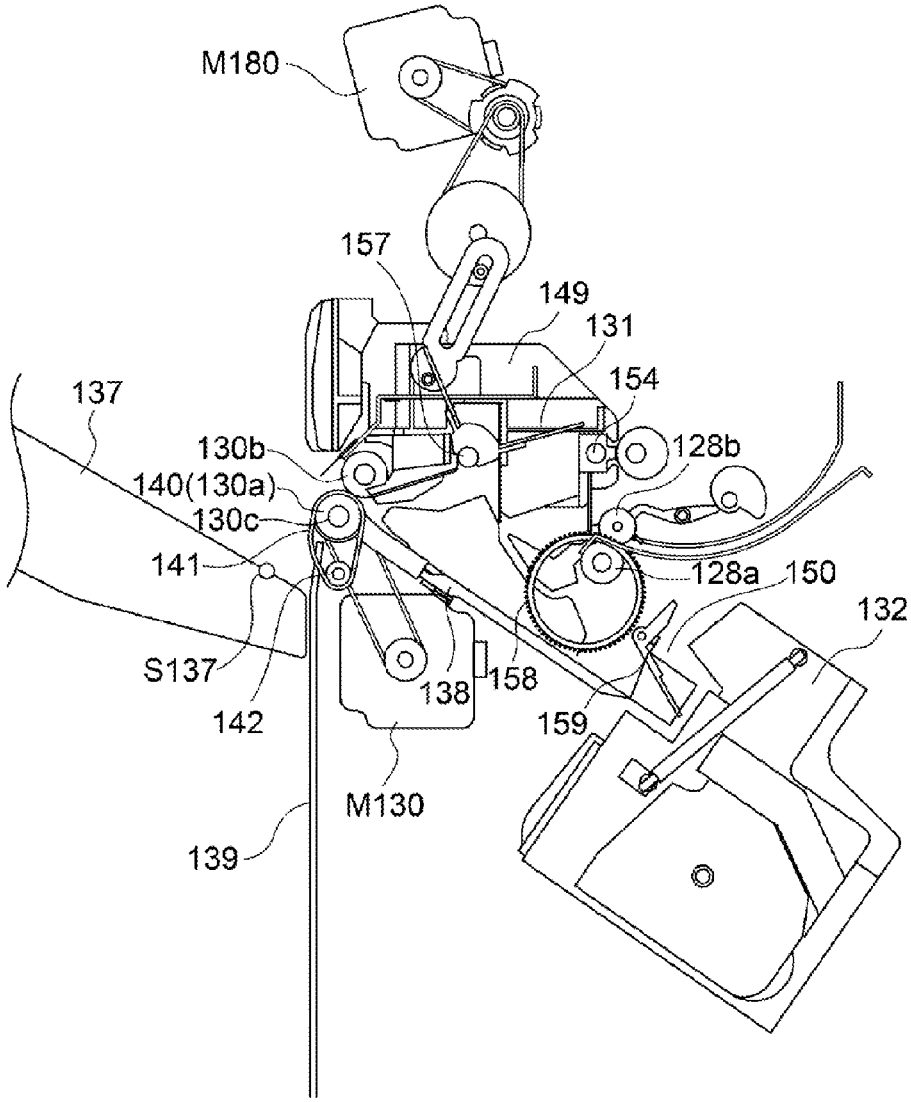
FIG. 6 is a sectional view illustrating a configuration of a main part of an intermediate processing tray portion in the finisher.
Figure 7:
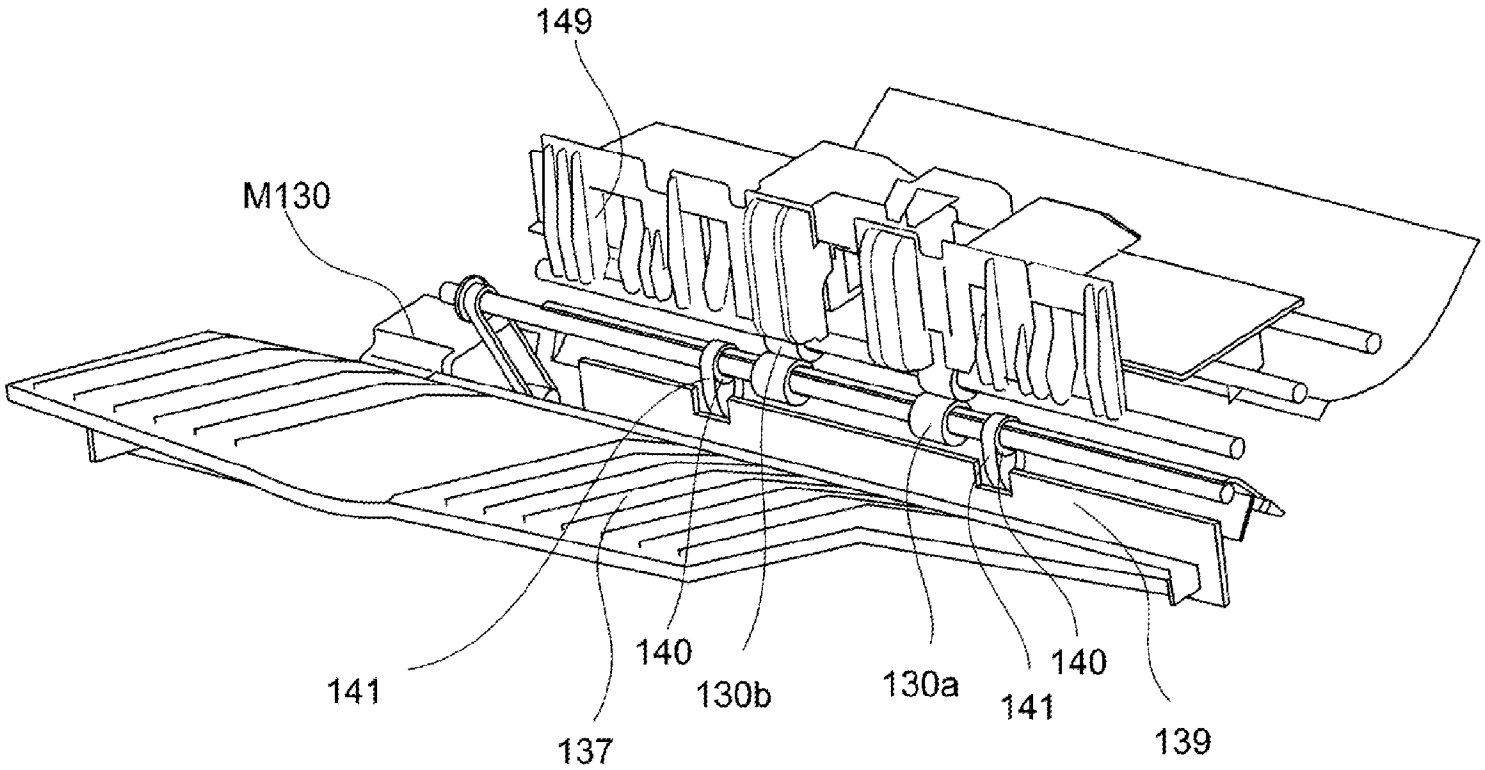
FIG. 7 is a perspective view illustrating a configuration of the intermediate processing tray portion in the finisher.

FIG. 6 is a front view of the intermediate processing tray portion of the finisher 100, and FIG. 7 is a perspective view of the discharge portion. A configuration of the intermediate processing tray portion including the intermediate processing tray 138 will be described with reference to FIGS. 6 and 7. As illustrated in FIG. 6, the intermediate processing tray 138 is obliquely provided such that a downstream side (a left side in FIG. 6) of the intermediate processing tray 138 is disposed upward with respect to the sheet bundle discharge direction while an upstream side is disposed downward, and a rear end stopper 150 is arranged in a lower end part that is the upstream side of the intermediate processing tray 138. The intermediate processing tray 138 may horizontally be provided.

Figure 10:
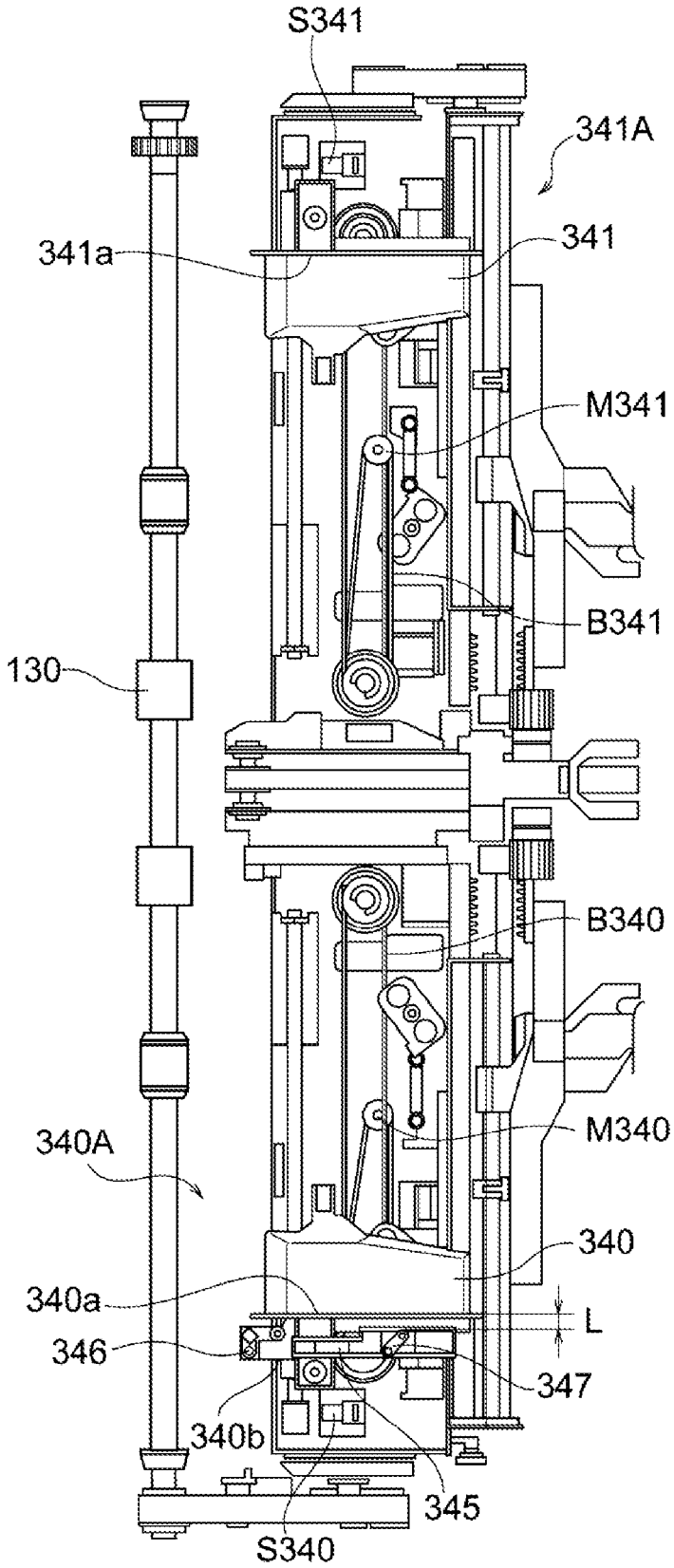
FIG. 10 is a plan view illustrating configurations of front and back aligning portions in the intermediate processing tray.

The intermediate processing tray 138 that is the intermediate stacking portion is provided on the upstream side of the stack tray 137 in the sheet discharge direction, and the intermediate processing tray 138 temporarily stacks the pre-discharge sheet thereon. As illustrated in FIG. 10, front and back aligning portions 340A and 341A are included in an intermediate part of the intermediate processing tray 138, and a lateral end regulating portion is provided in order to regulate both lateral end positions in the width direction of the sheet discharged to the intermediate processing tray 138. The front and back aligning portions 340A and 341A include front and back aligning plates 340 and 341 and front and back aligning plate motors M340 and M341. The front and back aligning plates 340 and 341 include aligning portions 340*a* and 341*a* constituting alignment surfaces. The front and back aligning plate motors M340 and M341 independently drive the front and back aligning plates 340 and 341.

In regulating both lateral end positions of the sheet, the driving of the front and back aligning plate motors M340 and M341 is transmitted to the front and back aligning plates 340 and 341 through timing belts B340 and B341. The timing belts B340 and B341 constitute a moving portion together with the front and back aligning plate motors M340 and M341. Therefore, the front and back aligning plates 340 and 341 move independently along the width direction with respect to the intermediate processing tray 138, and aligns the sheet by abutting on both the lateral end of the sheet stacked on the intermediate processing tray 138.

That is, the front aligning plate 340 that is the first aligning plate and the back aligning plate 341 that is the second aligning plate are disposed on the intermediate processing tray 138 while the aligning portions (alignment surfaces) 340*a* and 341*a* are opposed to each other, and the front aligning plate 340 and the back aligning plate 341 are assembled so as to be able to normally and reversely move in an alignment direction. As a result, even if the sheet (or the sheet bundle) is conveyed while shifted in the width direction, the position of the sheet on the intermediate processing tray 138 can be aligned using the front and back aligning plates 340 and 341.

One of the aligning plates, for example, the aligning portion 340*a* constituting the alignment surface of the front aligning plate 340 is provided so as to being movable in the width direction. A tension spring 345 is provided between the aligning portion 340*a* and a main body 340*b* of the front aligning plate 340, and the aligning portion 340*a* projects toward the sheet side by a predetermined amount L by the tension spring 345 and moving links 346 and 347. In regulating the lateral end position of the sheet, when the aligning portion 340*a* comes into contact with the sheet, the aligning portion 340*a* that is a contact portion moves onto the main body side against the tension spring 345.

In FIG. 10, front and back aligning plate home sensors S340 and S341 detect home positions of the front and back aligning plates 340 and 341. When the front and back aligning plates 340 and 341 are not operated, the front and back aligning plate home sensors S340 and S341 can cause the front and back aligning plates 340 and 341 to stand by at home positions set to both end parts.

Figure 11:
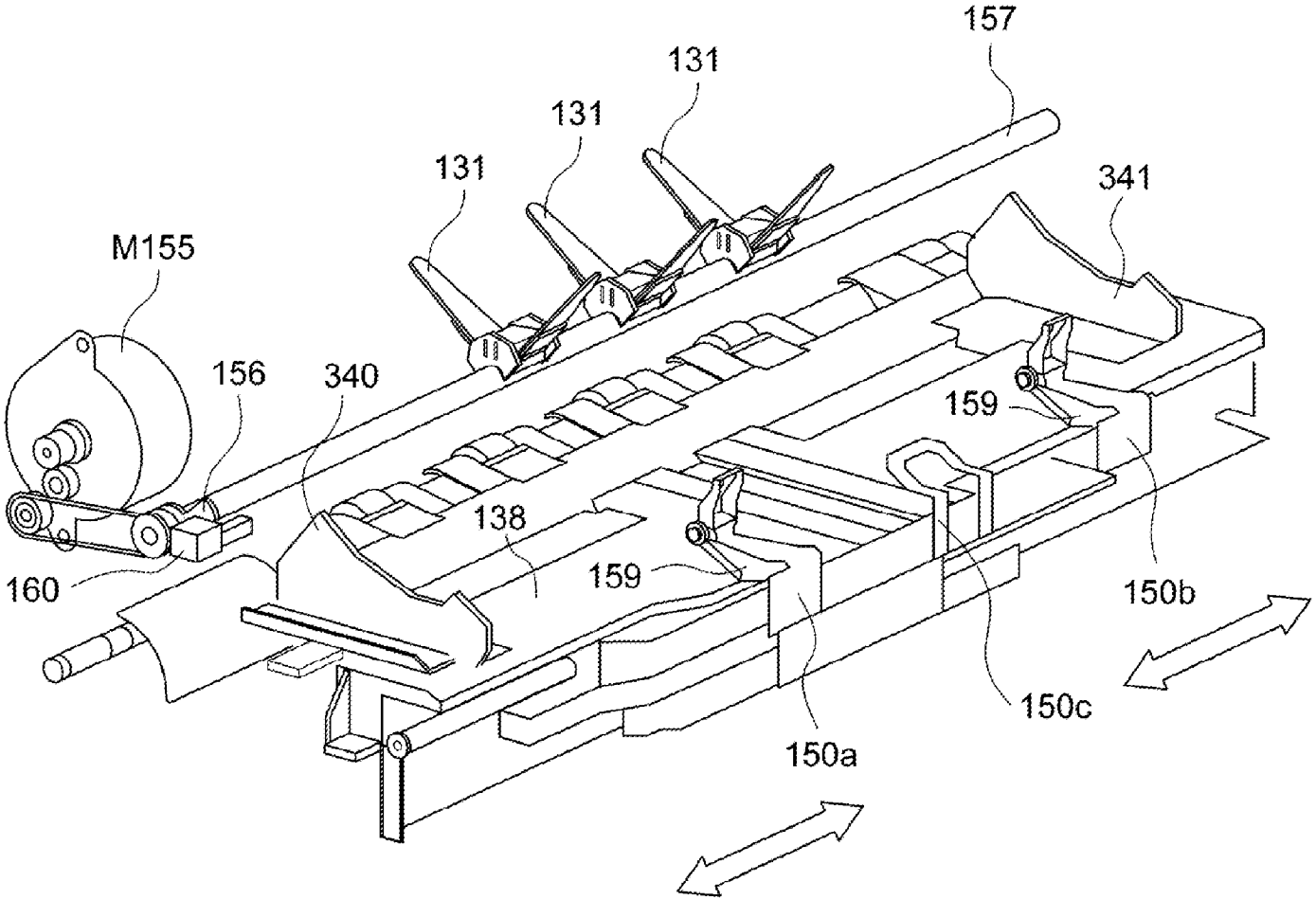
FIG. 11 is a perspective view illustrating a configuration of the intermediate processing tray.

As illustrated in FIG. 6, a retractable paddle 131 and a swing guide 149 are disposed in an upper end part that is of the downstream side of the intermediate processing tray 138 in a retracting direction. As illustrated in FIG. 11, the plurality of retractable paddles 131 is provided above the intermediate processing tray 138, and fixed onto a driving shaft 157 that is rotated by the paddle driving motor M155. The retractable paddles 131 are rotated counterclockwise in proper timing by the paddle driving motor M155.

The sheet discharged from the pair of lower discharge rollers 128 that is the conveying portion slides on a stacking surface of the intermediate processing tray 138 or the sheet stacked on the intermediate processing tray 138 by an inclination of the intermediate processing tray 138 and action of the retractable paddle 131. While guided by a rear end lever 159, the rear end (an upstream end in the discharge direction) of the sliding sheet abuts on the rear end stopper 150 that is of a stopper by the counterclockwise rotation of the belt roller 158 that is a sheet transfer portion. Therefore the sheet is stopped.

The belt roller 158 is provided above the intermediate processing tray 138 such that a lower part of the belt roller 158 comes into contact with the uppermost sheet stacked on the intermediate processing tray 138. The belt roller 158 is entrained about a lower discharge roller 128*a* constituting the pair of lower discharge rollers 128, and rotated counterclockwise by the rotation of the lower discharge roller 128*a*.

On the other hand, the swing guide 149 constituting the sheet discharge portion rotatably retains an upper discharge roller 130*b*. The an upper discharge roller 130*b* constitutes the pair of bundle discharge rollers 130 together with the lower discharge roller 130*a* that is provided in the end part on the downstream side of the intermediate processing tray 138. The upper discharge roller 130*b* comes into contact with and separates from the lower discharge roller 130*a* according to a swing motion of the swing guide 149. The pair of bundle discharge rollers 130 that is of the discharge portion is provided between the stack tray 137 and the intermediate processing tray 138, and normally or reversely rotated by the bundle discharge driving motor M130 (see FIG. 5) to convey the sheet in the direction of the stack tray 137 or the direction of the rear end stopper 150.

The swing guide 149 is a retaining member that retains the upper discharge roller 130*b* that is one of the pair of bundle discharge rollers 130, and the swing guide 149 is configured to swing vertically with a support shaft 154 as a support point by driving a swing guide opening and closing motor M180. Usually, when the sheet is discharged onto the intermediate processing tray 138, the swing guide 149 swings upward to become an opened state in which the upper discharge roller 130*b* separates from the lower discharge roller 130*a* that is the other pair of bundle discharge rollers 130.

When the process performed to the sheet is ended on the intermediate processing tray 138, the swing guide 149 swings downward, and the sheet bundle is nipped between the upper discharge roller 130*b* and the lower discharge roller 130*a*. Then the pair of bundle discharge rollers 130 rotates while the sheet bundle is nipped between the upper discharge roller 130*b* and the lower discharge roller 130*a*, thereby discharging the sheet bundle to the lower stack tray 137.

A stacking wall 139 served as a wall, on which the sheet rear end part (the upstream end in the sheet conveyance direction) on the stack tray 137 abuts, is provided between the stack tray 137 and the intermediate processing tray 138.

An outer peripheral surface of a conveying belt 141 is entrained about a scraping pulley 140 along the stacking wall 139. The outer peripheral surface of a conveying belt 141 is a scraping portion, and the scraping pulley 140 is provided in coaxial with the lower discharge roller 130*a* constituting the pair of bundle discharge rollers 130 that is the discharge portion (the pair of discharge rollers). In the conveying belt 141, deformation of the outer peripheral surface along the stacking wall 139 when the sheet is discharged to the stack tray 137 by the normal rotation of the lower discharge roller 130*a* is larger than the deformation of the outer peripheral surface when the sheet is moved toward the rear end stopper 150 by the reverse rotation of the lower discharge roller 130*a*. The conveying belt 141 will be described in detail.

In a rotating shaft 130*c* of the lower discharge roller 130*a*, the plurality of scraping pulleys 140 is provided in an axial direction of the rotating shaft 130*c*. In the embodiment, the two scraping pulleys 140 are provided by way of example. There is no limitation to the number of scraping pulleys 140, but at least three scraping pulleys 140 may be provided. A belt support roller 142 that is the rotating member is provided in each of lower parts of the scraping pulleys 140 that are aligned with each other in the axial direction of the rotating shaft 130*c*. The belt support roller 142 is configured such that a rotating shaft center part of the belt support roller 142 is axle-supported in a roller support plate (not illustrated). The conveying belt 141 that is of the endless belt is entrained between the scraping pulley 140 and the belt support roller 142 such that the outer peripheral surface of the conveying belt 141 becomes in parallel with the stacking wall 139. An inner peripheral part of the conveying belt 141 has a spur gear configuration, and engages with outer peripheral spur gear shapes of the scraping pulley 140 and the belt support roller 142, whereby the conveying belt 141 rotates normally and reversely together with the lower discharge roller 130*a* by the bundle discharge driving motor M130.

An interval between the scraping pulley 140 and the belt support roller 142 is set such that the conveying belt 141 rotates in the sheet discharge direction while maintaining a predetermined loose shape (curved shape) in which at least part of the conveying belt 141 projects from the stacking wall 139 toward the side of the stack tray 137.

The bundle discharge driving motor M130 (see FIG. 6) drives the lower discharge roller 130*a* that is of the lower roller, and the driving is transmitted to the belt support roller 142 through the conveying belt 141 from the scraping pulley 140 provided in coaxial with the lower discharge roller 130*a*. At this point, a tension is generated in the outer peripheral surface of the conveying belt 141 that is drawn in the scraping pulley 140 when the scraping pulley 140 rotates, and looseness is generated in the outer peripheral surface on the opposite side. That is, when the conveying belt 141 rotates in the direction in which the pair of bundle discharge rollers 130 discharges the sheet, the deformation (looseness) is generated in the outer peripheral surface (a first outer peripheral surface) along the stacking wall 139 on the opposite side to the outer peripheral surface (a second outer peripheral surface) located inside the stacking wall 139, and the first outer peripheral surface of the conveying belt 141 projects toward the side of the stack tray 137.

After a predetermined number of sheets are discharged, the stack tray 137 is stopped at a transmission position by light shielding/transmission information of a sensor light emitting/receiving portion of a tray position sensor S137 and vertical motion of the stack tray 137. Therefore, a sheet discharge stand-by position is determined in the stack tray 137. The region where the conveying belt 141 projects from the stacking wall 139 ranges from an intersection point of the stack tray 137 (or the uppermost stacked sheet) at the sheet discharge stand-by position detected by the tray position sensor S137 and the stacking wall 139 in the state to a predetermined upward position. The region is determined by the arrangements of the scraping pulley 140 and the belt support roller 142 with respect to the stacking wall 139. When the sheet rear end part abuts on the stacking wall 139 while the discharged sheet is stacked on the stack tray 137, the sheet rear end part does not abut on the conveying belt 141. Even if the sheets are sequentially stacked on the stack tray 137, the positional relationship between the sheet rear end part and the conveying belt 141 does not change because the tray position sensor S137 detects the uppermost stacked sheet on the stack tray 137.

Figure 8A:
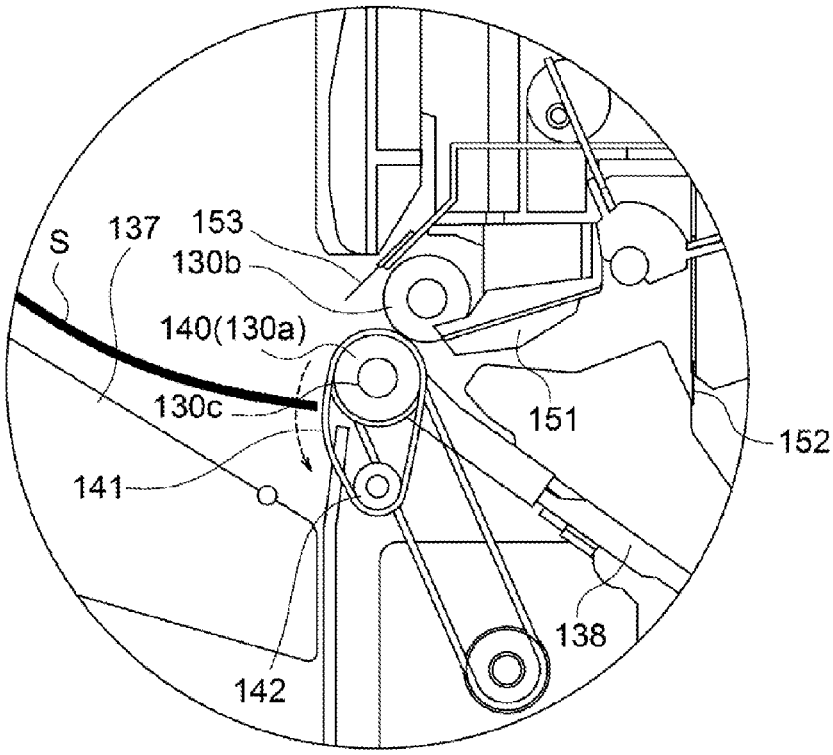
FIGS. 8A and 8B are partial sectional views illustrating a configuration of a discharge portion in the finisher.

FIG. 8A is a motion drawing when the lower discharge roller 130*a* is normally rotated counterclockwise to discharge the sheet to the stack tray. As illustrated in FIG. 8A, when being rotated counterclockwise, the conveying belt 141 maintains the state in which the outer peripheral surface of the conveying belt 141 projects partially from the stacking wall 139 toward the side of the stack tray 137. Therefore, the sheet discharged from the pair of the upper discharge roller 130*b* and the lower discharge roller 130*a* is stacked on the stack tray 137 while the sheet rear end part abuts on the conveying belt 141 to be scraped downward.

Figure 8B:
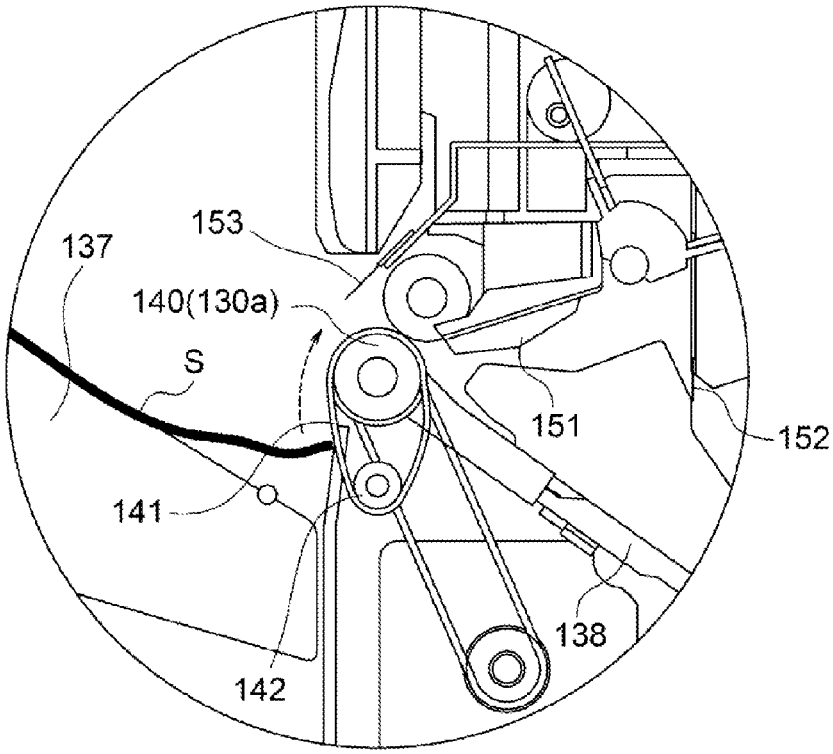

FIG. 8B is a motion drawing when the lower discharge roller 130*a* is reversely rotated clockwise to move the sheet in the direction of the intermediate processing tray. As illustrated in FIG. 8B, because the tension is generated on the outer peripheral surface side along the stacking wall 139 while the conveying belt 141 is rotated clockwise, a projection amount of the conveying belt 141 from the stacking wall 139 toward the side of the stack tray 137 is smaller than that of the normal rotation. Although the conveying belt 141 on the side of the stacking wall 139 rotates upward, because the projection amount is small, the sheet end part and the conveying belt 141 do not abut on each other at a high pressure even if the sheet rear end part is stacked while leaning on the stacking wall 139 in an upwardly curled state. Therefore, the sheet rear end part does not rise by the conveying belt 141, and a stacking fault and a reverse flow of the sheet in the direction of the intermediate processing tray 138 are not generated.

Figure 19A:
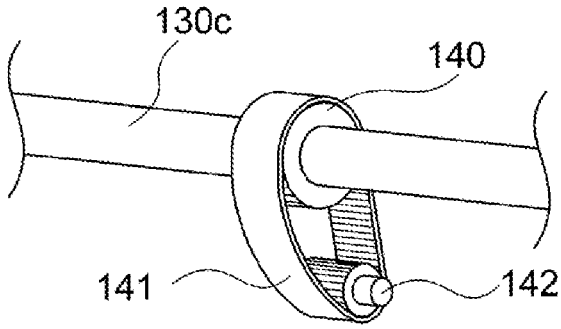
FIGS. 19A, 19B, and 19C are perspective views illustrating forms of conveying belt.

In the embodiment, by way of example, the conveying belt 141 entrained between the lower discharge roller 130*a* (scraping pulley 140) and the belt support roller 142 is an endless belt having a flat outer peripheral surface as illustrated in FIG. 19A. Embodiments are not limited thereto.

Figure 19B:
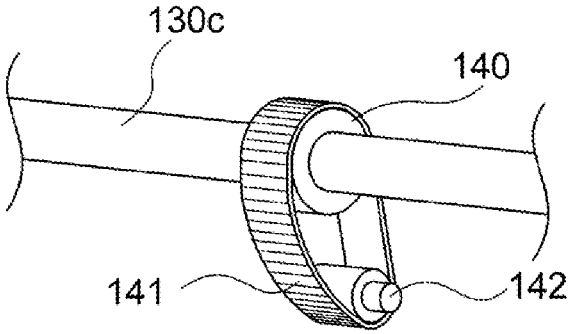
Figure 19C:
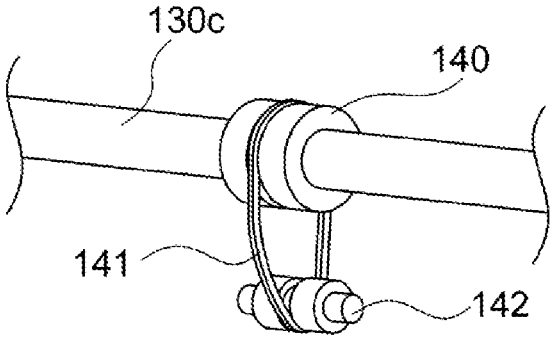

Alternatively, for example, when the conveying belt 141 has the irregular outer peripheral surface as illustrated in FIG. 19B, effectively the scraping effect is further improved. As illustrated in FIG. 19C, the conveying belt 141 may include a ring elastic rubber, or the inner peripheral surface of the conveying belt 141 and the outer peripheral surface of the scraping pulley 140 may have flat surfaces and the rotation may be transmitted by friction of a contact portion such as a friction belt.

A guide 151 is provided in the swing guide 149. The guide 151 is disposed on the upstream side of the upper discharge roller 130*b*, and guides the sheet to a roller nip portion of the upper discharge roller 130*b*. A first charge removal needle 152 is disposed in the swing guide 149 over the axial direction. The first charge removal needle 152 removes a surface charge of the sheet when the sheet is discharged from the pair of lower discharge rollers 128 into the intermediate processing tray 138. A second charge removal needle 163 is disposed in the swing guide 149 over the axial direction. The second charge removal needle 163 is disposed on the downstream side of the upper discharge roller 130*b*, and removes the surface charge of the sheet discharged from the pair of bundle discharge rollers 130.

Figure 9:
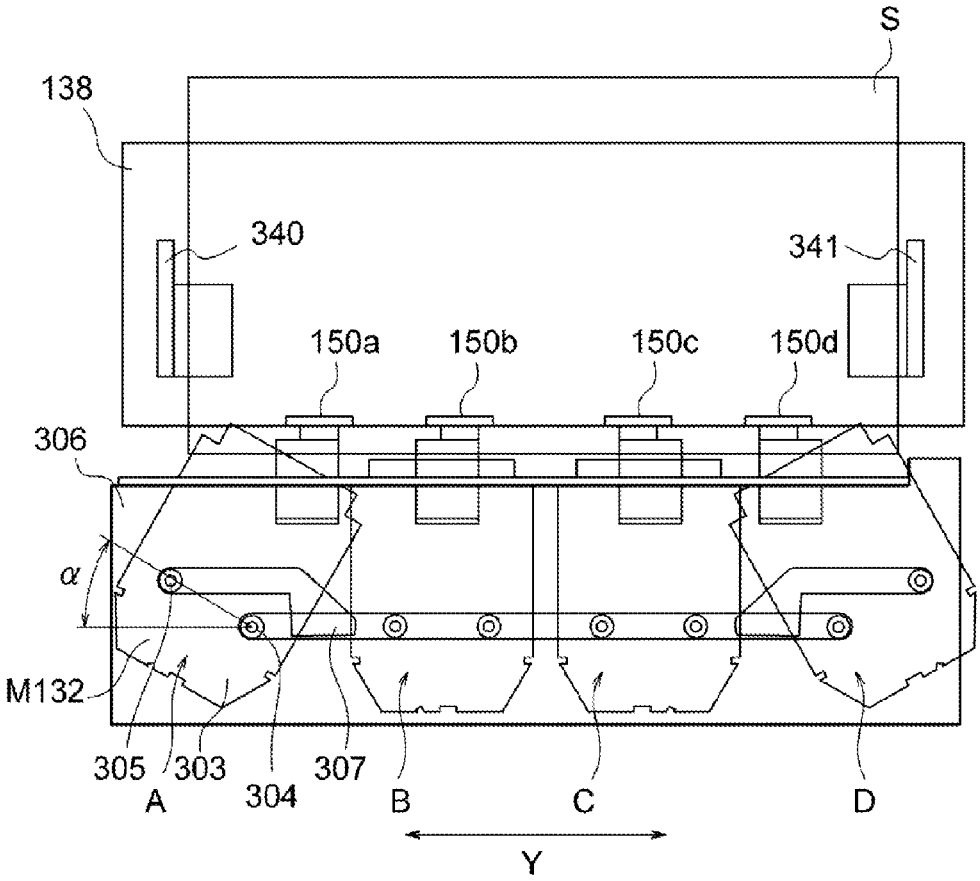
FIG. 9 is a plan view illustrating a stapler moving mechanism in the finisher.

The stapler 132 that is the binding portion performs the binding process to the end part of the sheet bundle using a clinch motor M132 in FIG. 9, and the stapler 132 is fixed onto a slide stand 303. Rollers 304 and 305 are provided in the lower part of the slide stand 303. The slide stand 303 is guided by the rollers 304 and 305 and a guide rail groove 307 on a stapler moving stage 306, and moves in the direction of an arrow Y along a rear end edge of the sheet stacked on the intermediate processing tray 138 by the stapler moving motor M303 (see FIG. 5).

At a corner of the sheet stacked on the intermediate processing tray 138, the stapler 132 maintains a posture in which the stapler 132 is inclined by a predetermined angle α with respect to the rear end edge of the sheet. The inclination angle α is set to about 30 degrees. However, the inclination angle α can be changed by changing the shape of the guide rail groove 307. The stapler home sensor S303 (see FIG. 5) that detects the home position of the stapler 132 is provided in the stapler moving stage 306. Usually the stapler 132 stands by at the home position on the front side.

The operations in an unbound sort mode and a staple sort mode of the finisher 100 will be described below.

The flow of the sheet and the operation of the intermediate processing tray portion in the unbound sort mode will be described with reference to FIGS. 12A, 12B, 13A, and 13B.

Figure 12A:
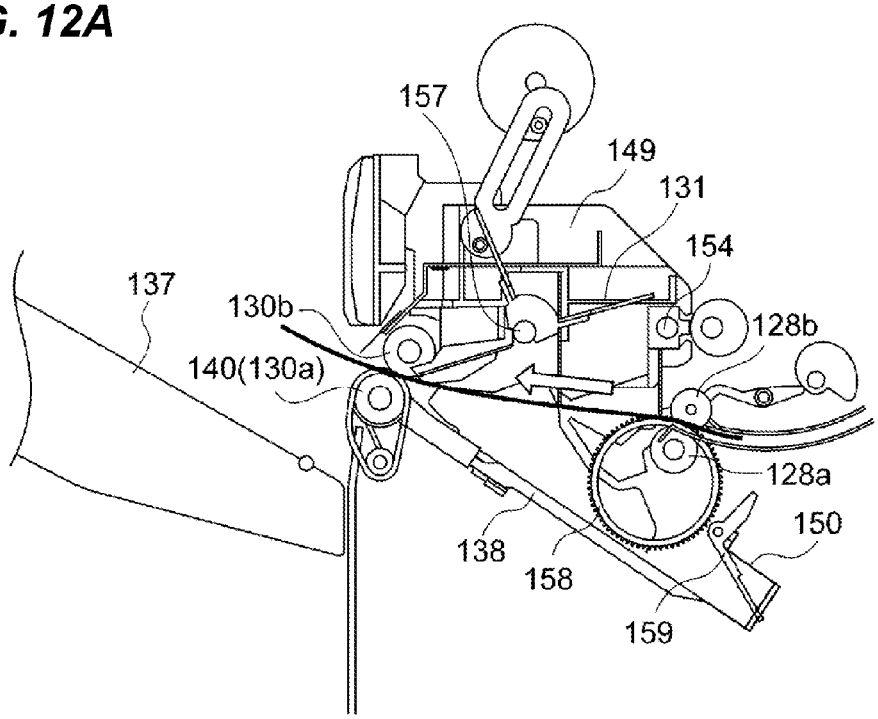
FIGS. 12A and 12B are sectional views of main parts illustrating a sheet flow during an unbound sort mode.
Figure 12B:
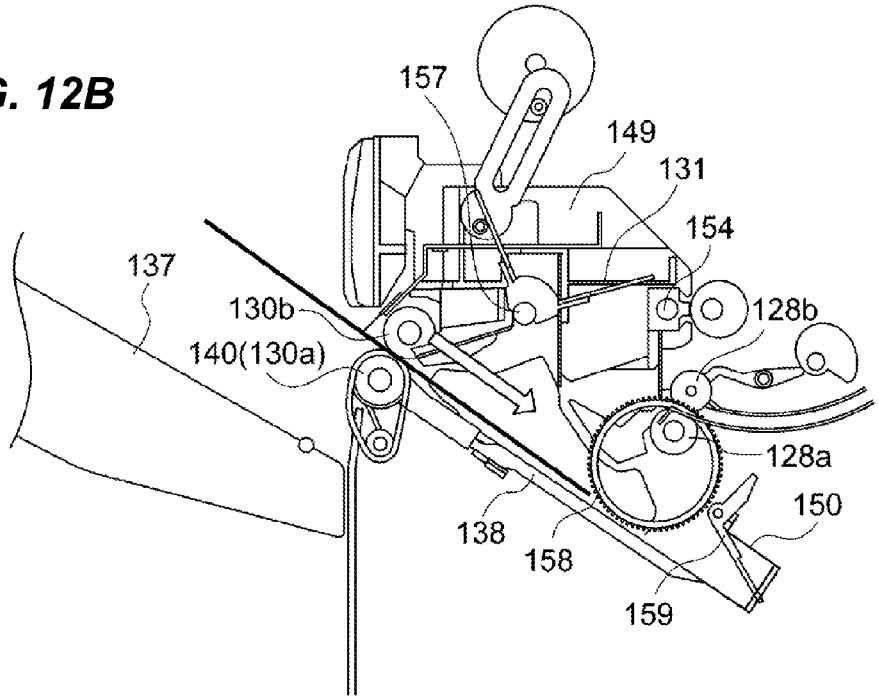
Figure 13A:
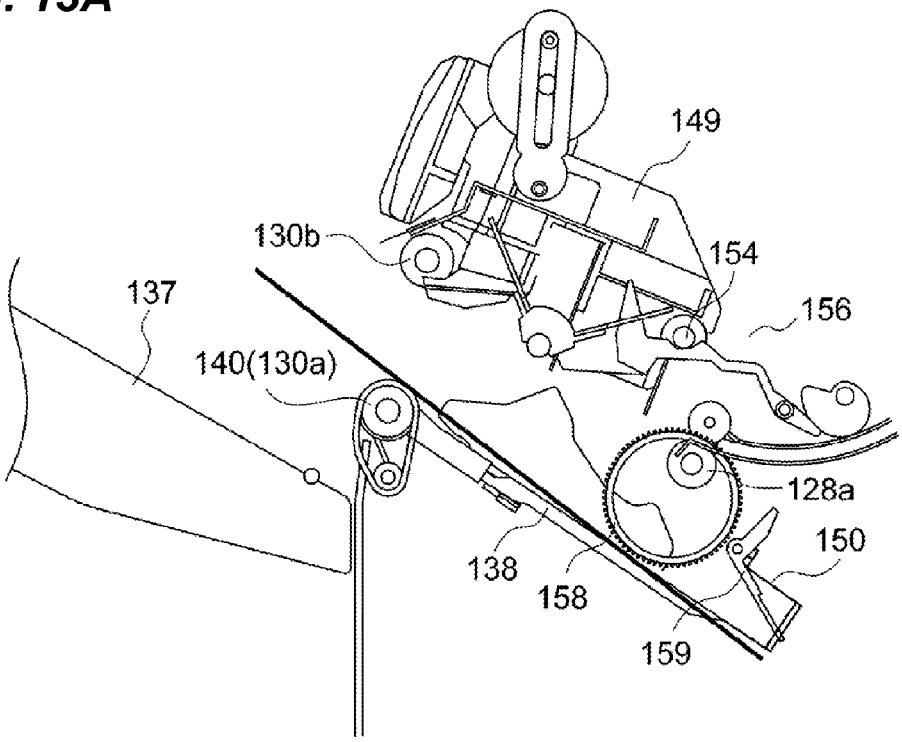
FIGS. 13A and 13B are sectional views of main parts illustrating the sheet flow during the unbound sort mode.
Figure 13B:
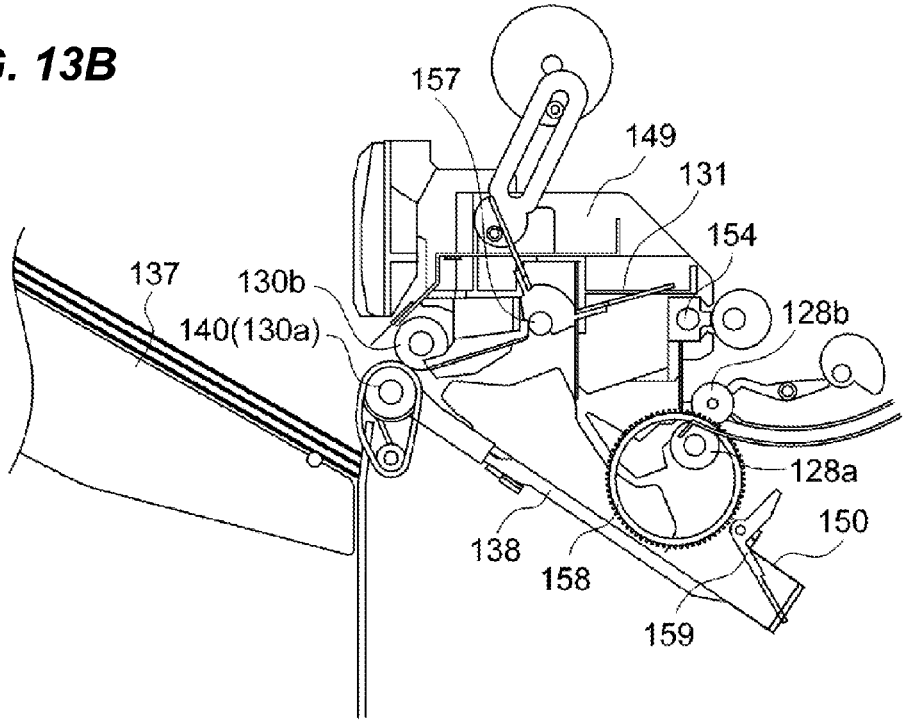
Figure 14A:
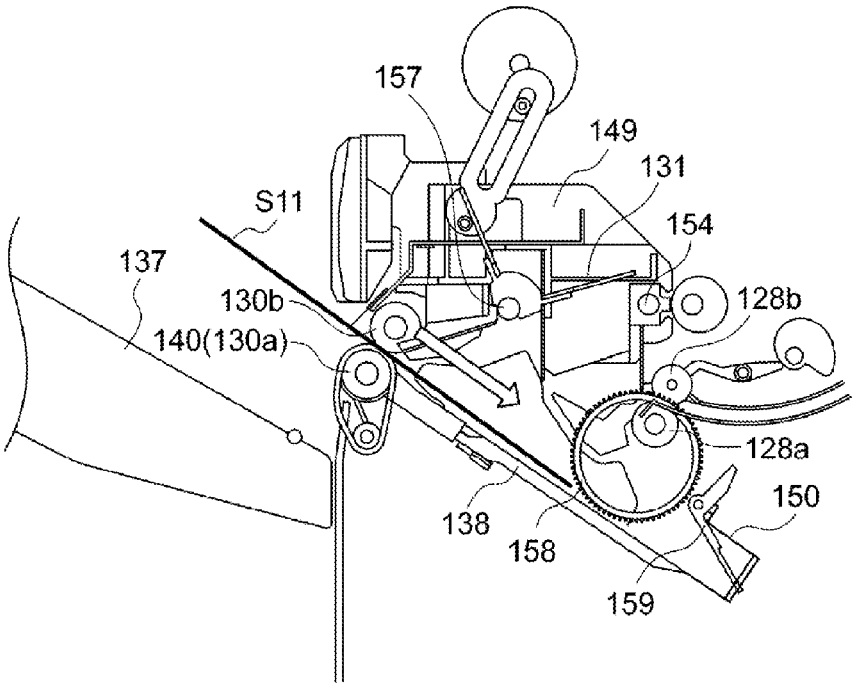
FIGS. 14A and 14B are sectional views of main parts illustrating the sheet flow during a stapled sort mode.
Figure 14B:
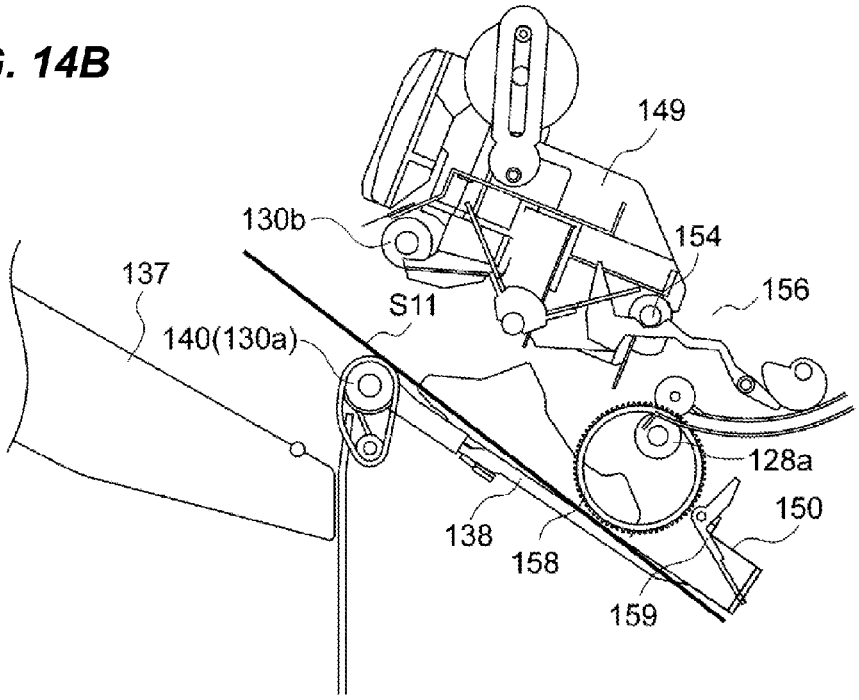

When a job in the unbound sort mode is selected, the sheet discharged from the apparatus body 602 passes through the conveying path 103 from the pair of entrance rollers 102, and is conveyed to the pair of buffer rollers 115 through the conveying rollers 105 and 106 by the conveying roller 110 and the separation roller 111. Then, as illustrated in FIGS. 12A and 12B, the sheet is conveyed onto the intermediate processing tray 138 by the normal and reverse rotations of the pair of lower discharge rollers 128 (128*a* and 128*b*) and the pair of bundle discharge rollers 130 (130*a* and 130*b*). As illustrated in FIG. 13A, the sheet is shifted in the width direction from the conveyance center position by 15 mm by the front aligning plate 340 and the back aligning plate 341. The shift motion is repeated on the intermediate processing tray 138 in each predetermined number of sheets, and the stacked sheets are discharged to the stack tray 137 by the pair of bundle discharge rollers 130 (130*a* and 130*b*) as illustrated in FIG. 13B.

At this point, the conveying belt 141 projects largely from the stacking wall 139 by the normal rotation of the lower discharge roller 130*a*, and rotates in the direction in which the sheet is scraped toward the stack tray 137. Therefore, the sheet discharged from the pair of bundle discharge roller 130 is stacked on the stack tray 137 while the sheet rear end part abuts on the conveying belt 141 to be scraped downward.

The similar operation is repeated for a designated sort number of sheets. In a second copy, the sheet is shifted to the opposite side (back side) to the shift direction of a first copy by a predetermined amount (15 mm), and the stacked sheets are discharged to the stack tray 137 by the pair of bundle discharge rollers 130 (130*a* and 130*b*). The one-time shift amount is determined to be 15 mm on one side from the conveyance center, the sheet is stacked on the stack tray 137 while a sort offset amount is set to 30 mm between the bundles. The sheets stacked on the intermediate processing tray 138 are discharged in consideration of sheet discharging and stacking property on the stack tray 137. Alternatively, the sheet may be discharged to the stack tray 137 every time the shift alignment operation is performed to one sheet.

In a case that a no-sort mode is designated, the sheet is discharged onto the intermediate processing tray 138, the conveyance center position of the sheet is corrected on the intermediate processing tray 138 by the front aligning plate 340 and the back aligning plate 341, and the sheet is discharged to the stack tray 137 by the pair of bundle discharge rollers 130.

When the sheet is aligned in the conveyance direction while the lower discharge roller 130*a* is reversely rotated to move the sheet in the direction of the rear end stopper 150, although the conveying belt 141 on the side of the stacking wall 139 rotates upward, the projection amount from the stacking wall 139 is smaller than that of the normal rotation. Therefore, even if the sheet is stacked in the upwardly curled state while the sheet rear end part leans on the stacking wall 139, the sheet end part and the conveying belt 141 do not abut on each other at the high pressure.

The flow of the sheet and the operation of the intermediate processing tray portion in the staple sort mode will be described below with reference to FIGS. 14 to 18. FIGS. 14 to 16 and 17 are motion drawings of the sheet in the intermediate processing tray portion, and FIG. 18 is a flowchart of a staple sort job.

Figure 18:
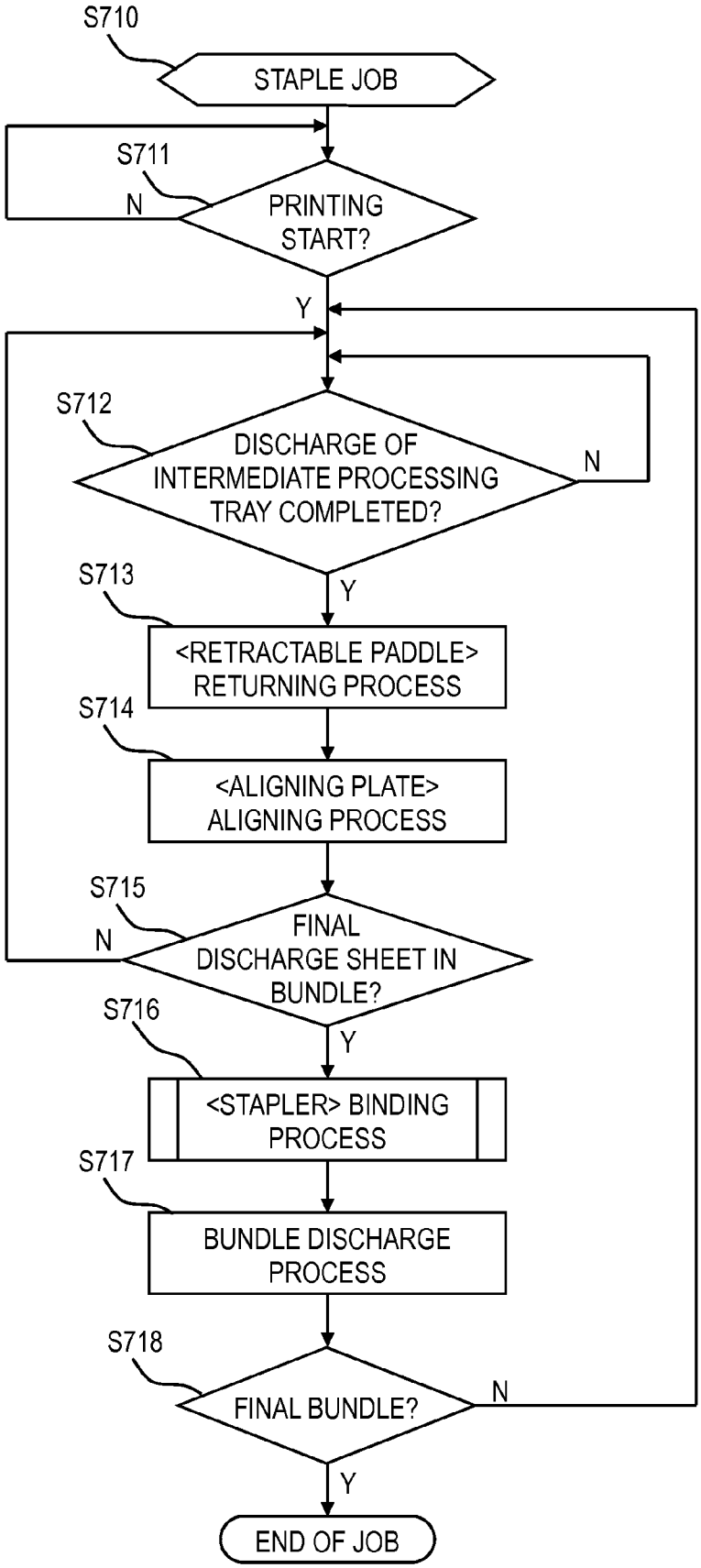
FIG. 18 is a flowchart illustrating motion of staple job control.

As illustrated in FIG. 18, when a staple job is selected to start printing (Steps S710 and S711), the apparatus body 602 sequentially forms the image from a first sheet S11 of the first copy. The first sheet S11 of the first copy, which is discharged from the apparatus body 602 is conveyed from the pair of lower discharge rollers 128 to the pair of the upper discharge roller 130*b* and the lower discharge roller 130*a*, and discharged to the intermediate processing tray 138 (Step S712). After the rear end of the sheet S11 is fed by a predetermined amount beyond the pair of lower discharge rollers 128, the pair of the upper discharge roller 130*b* and the lower discharge roller 130*a* is reversely rotated to convey the rear end of the sheet S11 in the direction of the rear end stopper 150 (see FIG. 14A).

Before the rear end of the sheet S11 abuts on the rear end stopper 150, the swing guide 149 is lifted to separate the upper discharge roller 130*b* from the lower discharge roller 130*a*. Therefore, the sheet S11 can abut on and be aligned by the rear end stopper 150 in the non-nipped state, and generation of buckling, which is particularly easily generated in the thin sheet, can be prevented (see FIG. 14B).

When the alignment of the sheet S11 is ended in the conveyance direction (sheet rear end part) while the swing guide 149 is retained at the lifted position, the aligning plates (aligning portion) 340 and 341 align the next sheet in the width direction (Step S714). The alignment operation in the width direction is performed to the first sheet S11 on the intermediate processing tray 138.

Figure 15A:
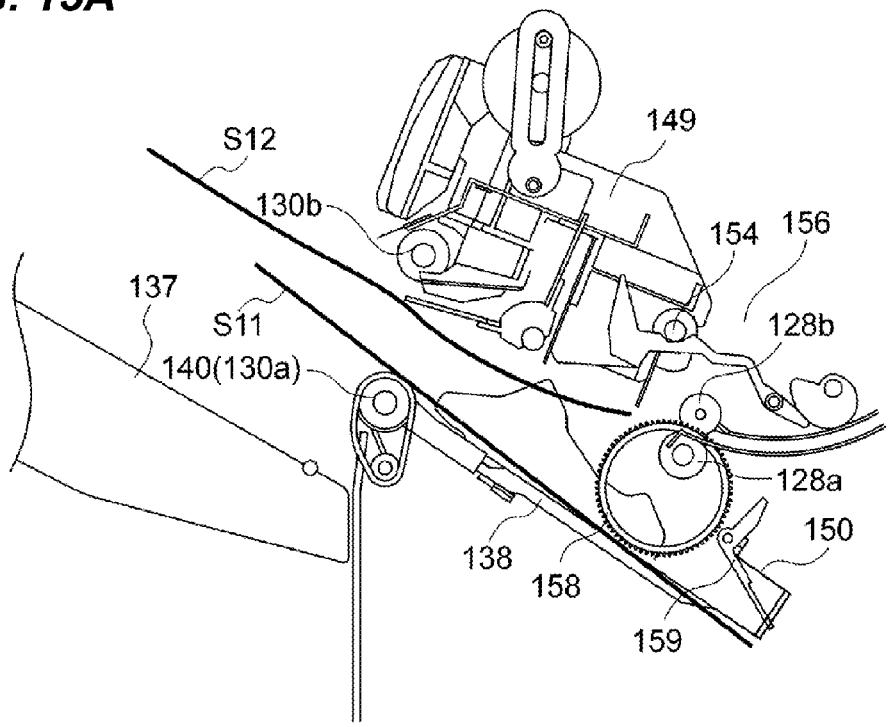
FIGS. 15A and 15B are sectional views of main parts illustrating the sheet flow during the stapled sort mode.
Figure 15B:
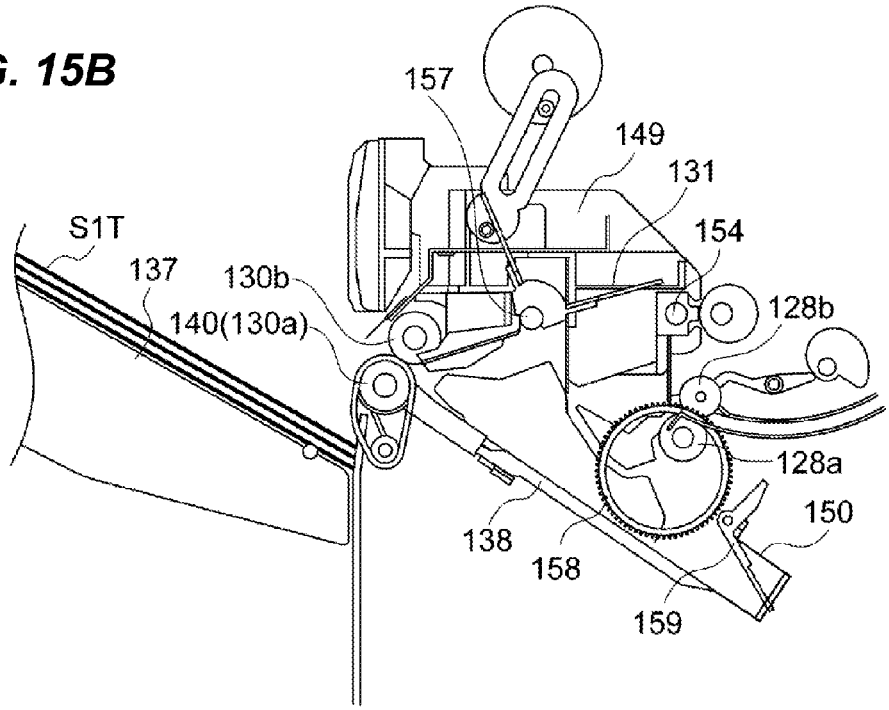
Figure 16:
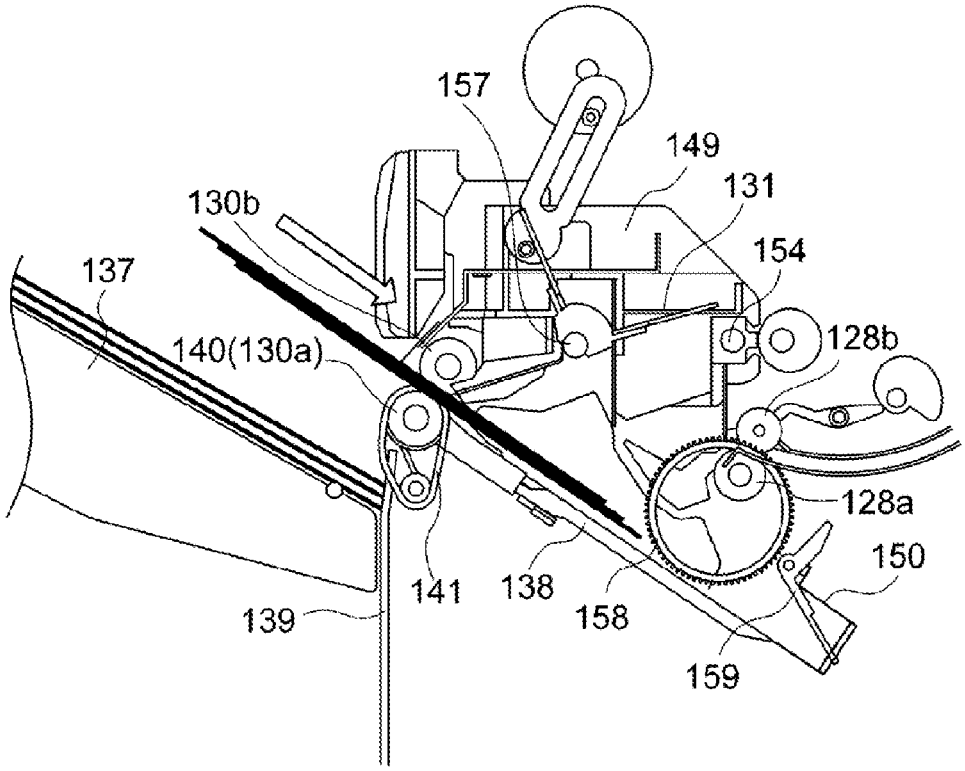
FIG. 16 is a sectional view of main parts illustrating the sheet flow during the stapled sort mode.

Then, a second sheet S12 is discharged from the pair of lower discharge rollers 128 to the intermediate processing tray 138 (Step S712), the retractable paddle 131 is rotated counterclockwise (Step S713), and the sheet rear end part is conveyed in the direction of the rear end stopper 150 (see FIG. 15A).

When the alignment of the sheet S12 is ended in the conveyance direction (sheet rear end part), the aligning plates 340 and 341 align the sheet S12 in the width direction similarly to the first sheet S11 (Step S714). The sequence of operations is repeated until a final sheet S1*n* of the first copy abuts on the rear end stopper 150. When the alignment operation of the final sheet S1*n* is ended (Step S715), the stapler 132 performs the staple process (binding process) to the rear end edge of a sheet bundle S1T (Step S716). Then the swing guide 149 is lowered, the sheet bundle S1T is discharged to the stack tray 137 while nipped between the upper discharge roller 130*b* and the lower discharge roller 130*a* (see FIG. 15B, Step S717).

At this point, the conveying belt 141 projects largely from the stacking wall 139 by the normal rotation of the lower discharge roller 130*a*, and rotates in the direction in which the sheet is scraped toward the stack tray 137. Therefore, the sheet discharged from the pair of bundle discharge roller 130 is stacked on the stack tray 137 while the sheet rear end part abuts on the conveying belt 141 to be scraped downward.

After the final sheet S1*n* abuts on the rear end stopper 150, it takes a longer time to perform the staple operation and the operation to discharge the bundle to the stack tray compared with the usual sheet process. Therefore, during the staple operation and the operation to discharge the bundle to the stack tray, the sheet cannot be fed in the intermediate processing tray 138, namely, a first sheet S21 of the second copy cannot be fed in the intermediate processing tray 138. Therefore, during the staple operation and the operation to discharge the bundle to the stack tray, the buffering (storage) process is performed to the sheet discharged from the apparatus body 602, and the sheet is not discharged to the intermediate processing tray 138 while the sheets of the next copy are sequentially received from the apparatus body 602. The sheets of the second copy are buffered until the sheet bundle of the first copy is discharged to the stack tray 137.

Figure 17:
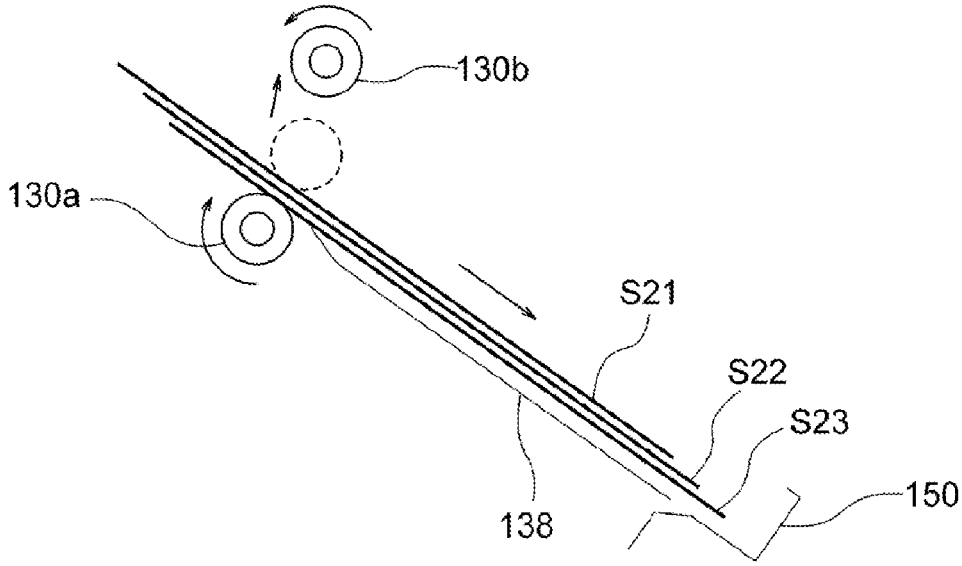
FIG. 17 is a schematic sectional view illustrating alignment of a sheet bundle to which a buffering process is performed.

In the embodiment, sheets S21, S22, and S23 of the second copy are buffered by way of example. As illustrated in FIG. 17, the sheets S21, S22, and S23 of the second copy buffered in a tile-stacking manner are conveyed in the sheet bundle state from the pair of lower discharge rollers 128 to the pair of bundle discharge rollers 130. After the rear end of the sheet bundle including the three sheets is fed by a predetermined amount beyond the pair of lower discharge rollers 128, the pair of bundle discharge rollers 130 is reversely rotated to convey the rear end of the sheet bundle in the direction of the rear end stopper 150 similarly to the first sheet of the first copy (see FIG. 16). Before the rear end part of the sheet bundle conveyed by the reverse rotation of the pair of bundle discharge rollers 130 abuts on the rear end stopper 150, the swing guide 149 is lifted to separate the upper discharge roller 130*b* from the lower discharge roller 130*a* (see FIG. 17).

At this point, the conveying belt 141 on the side of the stacking wall 139 rotates upward by the reverse rotation of the lower discharge roller 130*a*, and the conveying belt 141 on the side of the stacking wall 139 becomes the tension state. Therefore, the projection amount from the stacking wall 139 toward the side of the stack tray 137 decreases compared with the normal rotation. Even if the sheet is stacked in the upwardly curled state, or even if the sheet rear end part leans on the side of the stacking wall 139, the sheet end part and the conveying belt 141 do not abut on each other at the high pressure. Even if the conveying belt 141 rotates upward along the stacking wall 139, because the projection amount of the conveying belt 141 from the stacking wall 139 is small, the sheet rear end part does not rise by the conveying belt 141, and abnormal operations such as the stacking fault and the reverse flow of the sheet in the direction of the intermediate processing tray 138 are not generated.

A relationship of Vb>Ve holds in the lower discharge roller 130*a*. Where Vb is a conveying speed when the sheet is moved toward the rear end stopper 150 by the reverse rotation, and Ve is a discharge speed before and after the sheet rear end part passes through the lower discharge roller 130*a* when the sheet is discharged to the stack tray 137 by the normal rotation. In the lower discharge roller 130*a*, acceleration during start-up from the stopping state to the conveying speed Vb is larger than that during start-up from the stopping state to the discharge speed Ve. Therefore, the projection amount of the conveying belt 141 from the stacking wall 139 toward the side of the stack tray 137 can further be decreased during the reverse rotation.

After the buffering process, the fourth sheet to the final sheet S2*n* of the second copy are discharged and aligned one by one similarly to the first copy, and the staple process and the process to discharge the sheet bundle to the stack tray 137 are performed to the sheet bundle of the second copy. The sequence of operations is repeatedly performed to a designated number of copies (Step S718), and then the staple sort job is ended.

As described above, the conveying belt 141 is rotated by the rotation of the pair of bundle discharge rollers 130 to change the projection amount of the conveying belt 141 from the stacking wall 139. Specifically, in the conveying belt 141, the position of the outer peripheral surface along the stacking wall 139 is displaced by the deformation of the outer peripheral surface when the conveying belt 141 is normally rotated to convey the sheet to the stack tray 137. Therefore, the projection amount of the conveying belt 141 from the stacking wall 139 increases, and the conveying belt 141 abuts on the rear end part of the discharged sheet to scrape the sheet onto the stack tray 137. On the other hand, in the conveying belt 141, the deformation of the outer peripheral surface along the stacking wall 139 decreases compared with the normal rotation when the conveying belt 141 is reversely rotated to move the sheet toward the rear end stopper 150 of the intermediate processing tray 138. Therefore, the projection amount of the conveying belt 141 from the stacking wall 139 decreases compared with the normal rotation. The sheet rear end part and the conveying belt 141 do not abut on each other. Accordingly, the conveying belt 141 can hold the sheet toward the stack tray 137 during the normal rotation, and the sheet end part is hardly disarrayed by the conveying belt 141 during the reverse rotation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-186468, filed Aug. 27, 2012, and No. 2013-147490, filed Jul. 16, 2013, which are hereby incorporated by reference herein in their entirety.

What is claimed is:

1. A sheet processing apparatus comprising:

a conveying portion that conveys a sheet;

an intermediate stacking portion that temporarily stacks the sheet conveyed by the conveying portion;

a stopper that regulates an upstream end in a conveyance direction of the sheet stacked on the intermediate stacking portion;

a stacking portion on which the sheet discharged from the intermediate stacking portion is stacked;

a pair of discharge rollers that is provided in the intermediate stacking portion to move the sheet conveyed to the intermediate stacking portion toward the stopper or to discharge the sheet regulated by the stopper to the stacking portion according to a rotation direction;

a wall that is provided between the stacking portion and the pair of discharge rollers, the upstream end in the conveyance direction of the sheet discharged to the stacking portion abutting on the wall; and an endless belt that includes an outer peripheral surface along the wall, the outer peripheral surface moving in conjunction with rotation of the pair of discharge rollers, wherein the outer peripheral surface along the wall of the endless belt is projected from the wall by deformation of the outer peripheral surface when the pair of discharge rollers discharges the sheet to the stacking portion, and wherein the deformation of the outer peripheral surface along the wall when the pair of discharge rollers discharges the sheet to the stacking portion is larger than that when the pair of discharge rollers moves the sheet toward the stopper of the intermediate stacking portion.

2. The sheet processing apparatus according to claim 1, wherein the endless belt is entrained such that driving of a lower roller in the pair of discharge rollers is transmitted to a rotating member provided below the lower roller, looseness is generated in the outer peripheral surface when the pair of discharge rollers discharges the sheet to the stacking portion, and a tension is generated when the pair of discharge rollers moves the sheet toward the stopper of the intermediate stacking portion.

3. The sheet processing apparatus according to claim 2, wherein an interval between the lower roller and the rotating member is set such that the endless belt rotates while maintaining a curved shape in which at least part of the outer peripheral surface projects from the wall when the sheet is discharged to the stacking portion.

4. The sheet processing apparatus according to claim 1, wherein the outer peripheral surface projects from the wall at a position that is higher than an intersection point of the stacking portion or the uppermost sheet stacked on the stacking portion and the wall by a predetermined amount.

5. The sheet processing apparatus according to claim 1, wherein a relationship of Vb>Ve holds in the pair of discharge rollers, where Vb is a conveying speed when the sheet is moved toward the stopper of the intermediate stacking portion and Ve is a discharge speed when the sheet is discharged to the stacking portion.

6. The sheet processing apparatus according to claim 5, wherein, in the pair of discharge rollers, an acceleration during start-up to the discharge speed Ve is larger than an acceleration during start-up to the conveying speed Vb.

7. An image forming apparatus comprising:

an image forming portion that forms an image in a sheet; and a sheet processing apparatus that processes the sheet in which the image is formed by the image forming portion, the sheet processing apparatus including:

a conveying portion that conveys a sheet;

an intermediate stacking portion that temporarily stacks the sheet conveyed by the conveying portion;

a stopper that regulates an upstream end in a conveyance direction of the sheet stacked on the intermediate stacking portion;

a stacking portion on which the sheet discharged from the intermediate stacking portion is stacked;

a pair of discharge rollers that is provided in the intermediate stacking portion to move the sheet conveyed to the intermediate stacking portion toward the stopper or to discharge the sheet regulated by the stopper to the stacking portion according to a rotation direction;

a wall that is provided between the stacking portion and the pair of discharge rollers, the upstream end, in the conveyance direction, of the sheet discharged to the stacking portion abutting on the wall; and an endless belt that includes an outer peripheral surface along the wall, the outer peripheral surface moving in conjunction with rotation of the pair of discharge rollers, wherein the outer peripheral surface along the wall of the endless belt is projected from the wall by deformation of the outer peripheral surface when the pair of discharge rollers discharges the sheet to the stacking portion, and wherein the deformation of the outer peripheral surface along the wall when the pair of discharge rollers discharges the sheet to the stacking portion is larger than that when the pair of discharge rollers moves the sheet toward the stopper of the intermediate stacking portion.

8. The image forming apparatus according to claim 7, wherein the endless belt is entrained such that driving of a lower roller in the pair of discharge rollers is transmitted to a rotating member provided below the lower roller, looseness is generated in the outer peripheral surface when the pair of discharge rollers discharges the sheet to the stacking portion, and a tension is generated when the pair of discharge rollers moves the sheet toward the stopper of the intermediate stacking portion.

9. The image forming apparatus according to claim 8, wherein an interval between the lower roller and the rotating member is set such that the endless belt rotates while maintaining a curved shape in which at least part of the outer peripheral surface projects from the wall when the sheet is discharged to the stacking portion.

10. The image forming apparatus according to claim 7, wherein the outer peripheral surface of the endless belt projects from the wall at a position that is higher than an intersection point of the stacking portion or the uppermost sheet stacked on the stacking portion and the wall by a predetermined amount.

11. The image forming apparatus according to claim 7, wherein a relationship of Vb>Ve holds in the pair of discharge rollers, where Vb is a conveying speed when the sheet is moved toward the stopper of the intermediate stacking portion and Ve is a discharge speed when the sheet is discharged to the stacking portion.

12. The image forming apparatus according to claim 11, wherein, in the pair of discharge rollers, an acceleration during start-up to the discharge speed Ve is larger than an acceleration during start-up to the conveying speed Vb.

* * * * *